US008523339B2

(12) United States Patent
Tokuno

(10) Patent No.: US 8,523,339 B2
(45) Date of Patent: Sep. 3, 2013

(54) IMAGE FORMING APPARATUS

(75) Inventor: Toshiroh Tokuno, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 89 days.

(21) Appl. No.: 13/308,728

(22) Filed: Dec. 1, 2011

(65) Prior Publication Data

US 2012/0139979 A1 Jun. 7, 2012

(30) Foreign Application Priority Data

Dec. 6, 2010 (JP) ..... 2010-271174

(51) Int. Cl.
*B41J 2/175* (2006.01)
*B41J 2/195* (2006.01)

(52) U.S. Cl.
USPC ..... 347/86; 347/7

(58) Field of Classification Search
CPC ..... B41J 2/17566; B41J 2/17563
USPC ..... 347/6, 7, 84–86
See application file for complete search history.

(56) References Cited

U.S. PATENT DOCUMENTS 6,412,894 B1 7/2002 Askren et al.
6,712,460 B2 * 3/2004 Ohashi et al. ..... 347/86
7,540,598 B2 6/2009 Hori et al.
7,871,158 B2 * 1/2011 Kaneko ..... 347/86
2010/0231622 A1 9/2010 Sasaki et al.
2011/0050816 A1 3/2011 Katoh et al.
2011/0134184 A1 6/2011 Katoh et al.
2011/0141167 A1 6/2011 Kikkawa et al.
2011/0226340 A1 9/2011 Tokuno

FOREIGN PATENT DOCUMENTS

JP 2004-174832 6/2004
JP 2007-105935 4/2007
JP 2011-183729 9/2011

OTHER PUBLICATIONS

Apr. 18, 2012 European search report in connection with counterpart European patent application No. 11 190 364.7.

* cited by examiner

*Primary Examiner* — An Do
(74) *Attorney, Agent, or Firm* — Cooper & Dunham LLP

(57) ABSTRACT

An image forming apparatus includes a head tank, a main tank, a pump, and a first control unit, so that when pressure in the head tank is not restored to a predetermined pressure while liquid is supplied from the main tank to the head tank, it is determined that the state of the main tank is an empty state, causing a pump to reversely supply a predetermined amount of liquid from the head tank to the main tank, and stopping printing; and further includes a second control unit, so that when emergency printing is instructed, opening the head tank to air, supplying liquid to the head tank, closing the head tank from air, and supplying liquid from the head tank to the main tank to generate a negative pressure in the head tank are performed.

6 Claims, 19 Drawing Sheets

IMAGE FORMING APPARATUS

CROSS-REFERENCE TO RELATED APPLICATIONS

The present application claims priority under 35 U.S.C §119 to Japanese Patent Application No. 2010-271174 filed Dec. 6, 2010, the entire contents of which are hereby incorporated herein by reference.

BACKGROUND OF THE INVENTION

1. Field of the Invention

The present invention relates to an image forming apparatus, and more particularly to an image forming apparatus having a recording head and a head tank, the recording head discharging liquid droplets, the head tank supplying a fluid to the recording head.

2. Description of the Related Art

As an image forming apparatus such as a printer, a facsimile machine, a copier, a plotter, a multi function peripheral thereof and the like, there has been known an inkjet recording apparatus and the like employing a liquid discharging recording method using a recording head discharging ink droplets or the like.

In the image forming apparatus employing the liquid discharging recording method, an image is formed by discharging ink droplets from a recording head onto a fed sheet. Herein, the term "forming" is a synonym of the terms recording, typing, imaging, and printing.

Further, herein, the term "sheet" is not limited to paper, and refers to any appropriate medium (e.g., the OHP) to which ink droplets, other liquid and the like may be adhered. The image forming apparatus employing the liquid discharging recording method may be classified into two types: a serial-type image forming apparatus and a line-type image forming apparatus.

In the serial-type image forming apparatus, an image is formed by discharging ink droplets from the recording head while the recording head moves in the main scanning direction. On the other hand, in the line-type image forming apparatus, an image is formed by discharging ink droplets from the line-type recording head while the recording head does not change its position.

Further, in an embodiment of the present invention, the term "image forming apparatus" employing the liquid discharging recording method refers to an apparatus forming an image by discharging a liquid onto a medium including paper, thread, fiber, textile, leather, metal, plastic, glass, wood, ceramics and the like.

Further, the term "image forming" refers to not only forming a meaningful image such as characters, figures, and the like on a medium but also forming a meaningless image such as a pattern and the like on a medium (including simply discharging droplets onto a medium).

Further, the term "ink" is collectively used and herein refers to not only any material called "ink" but also any liquid for forming an image which may be called recording liquid, fixing processing liquid, liquid, a DNA sample, a patterning material, a resin and the like.

Further, the "image" is not limited to a planar image. For example, the "image" includes an image formed on a material that is three-dimensionally formed and an image three-dimensionally formed made of three-dimensional figures.

Among such image forming apparatuses there is a known image forming apparatus employing an ink supply method in which ink is supplied from a main tank to a head tank, the main tank (a.k.a. an ink cartridge) being detachably mounted on a main body of the apparatus, the head tank (also called a sub tank or a buffer tank) supplying ink to the recording head.

When the ink cartridge is in an ink-end condition (an end state) (i.e., an ink-empty condition (an empty state)), including an ink-near-end condition (i.e., an ink-near-end condition), exchange of the ink cartridge may be suggested. However, when there is no stock of the ink cartridge, the ink cartridge may not be exchanged immediately. As a result, printing may have to be interrupted.

To overcome the inconvenience, there is a know technique in which emergency printing using ink remaining in the head tank is performed to continue printing (see, Japanese Laid-open Patent Publication No. 2011-183729).

To that end, in a case where ink is supplied from the main tank to the head tank, when the pressure in the head tank is less than a predetermined pressure, an air opening mechanism of the head tank is opened to increase the pressure in the head tank. Then, the liquid is pumped from the head tank to the main tank by a reversible-type fluid supply unit to control reducing the negative pressure in the head tank.

SUMMARY OF THE INVENTION

According to an aspect of the present invention, an image forming apparatus includes a recording head discharging liquid droplets; a head tank including a liquid container containing liquid to be supplied to the recording head and an air opening mechanism opening and closing the liquid container to air; a main tank containing liquid to be supplied to the head tank; a reversible-type fluid supply unit disposed between the head tank and the main tank and supplying liquid; a pressure detector detecting a pressure in the head tank; a first control unit, when the pressure in the head tank is not restored to a predetermined pressure while liquid is supplied from the main tank to the head tank, determining that the state of the main tank is an empty state, causing the reversible-type fluid supply unit to reversely rotate to reversely supply a predetermined amount of liquid from the head tank to the main tank, and stopping printing; and a second control unit, when the printing is stopped by the first control unit and emergency printing is instructed using liquid remaining in the image forming apparatus, causing the air opening mechanism of the head tank to open, causing the reversible-type fluid supply unit to normally rotate to the supply liquid to the head tank, the liquid having been reversely supplied to the main tank, causing the air opening mechanism to close, and causing the reversible-type fluid supply unit to reversely rotate to reversely supply the liquid from the head tank to the main tank to generate a predetermined negative pressure in the head tank.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In an image forming apparatus in the related art, when an emergency printing using ink remaining in the head tank can be performed, it may be desired to continue printing as long as possible by reducing ink to be wastefully consumed.

The present invention is made in light of the above requirement, and may provide an image forming apparatus that reduces ink to be wastefully consumed in the emergency printing.

Figure 1:
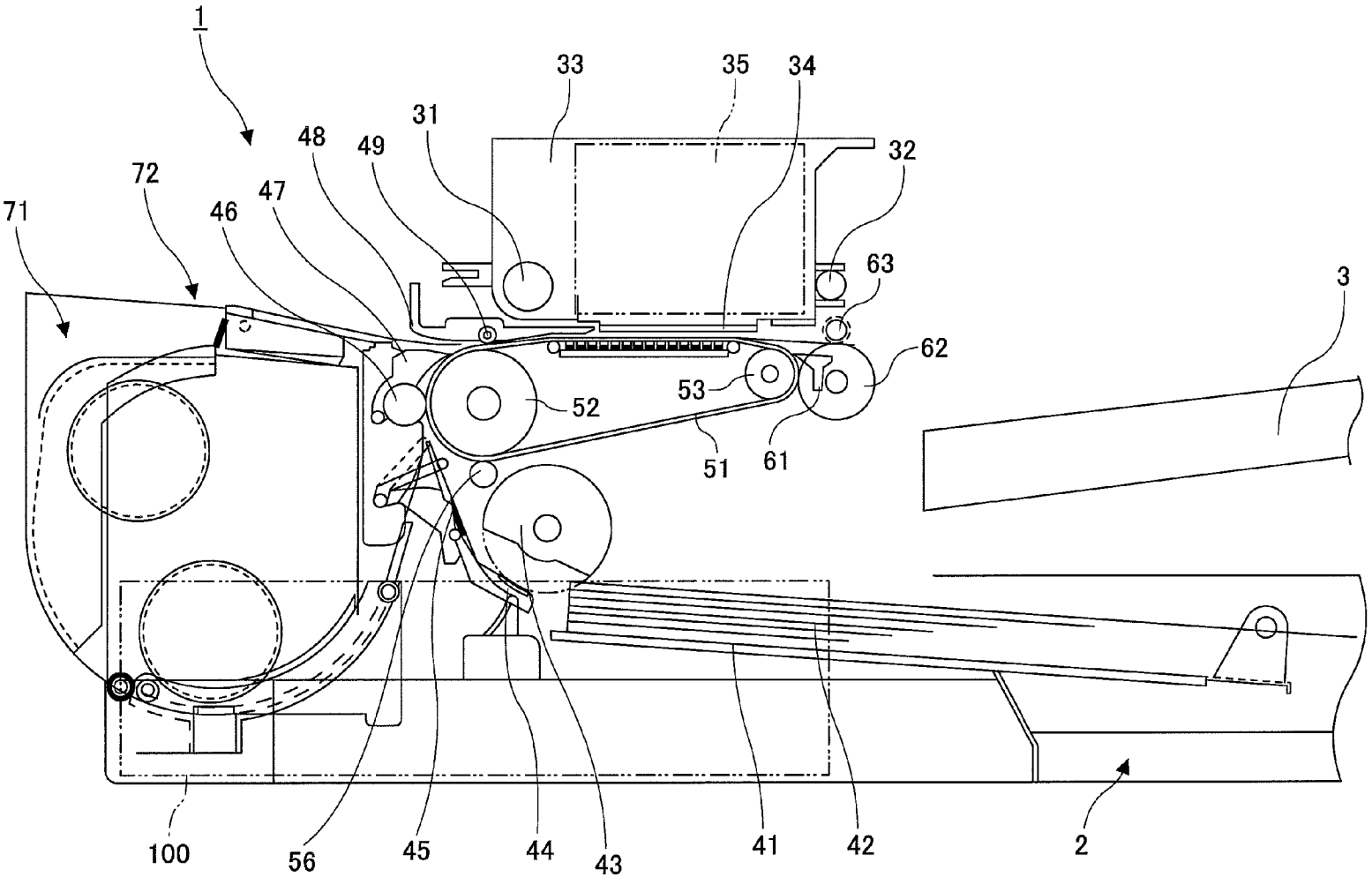
FIG. 1 is a schematic side view of a mechanical part of an image forming apparatus according to an embodiment of the present invention.
Figure 2:
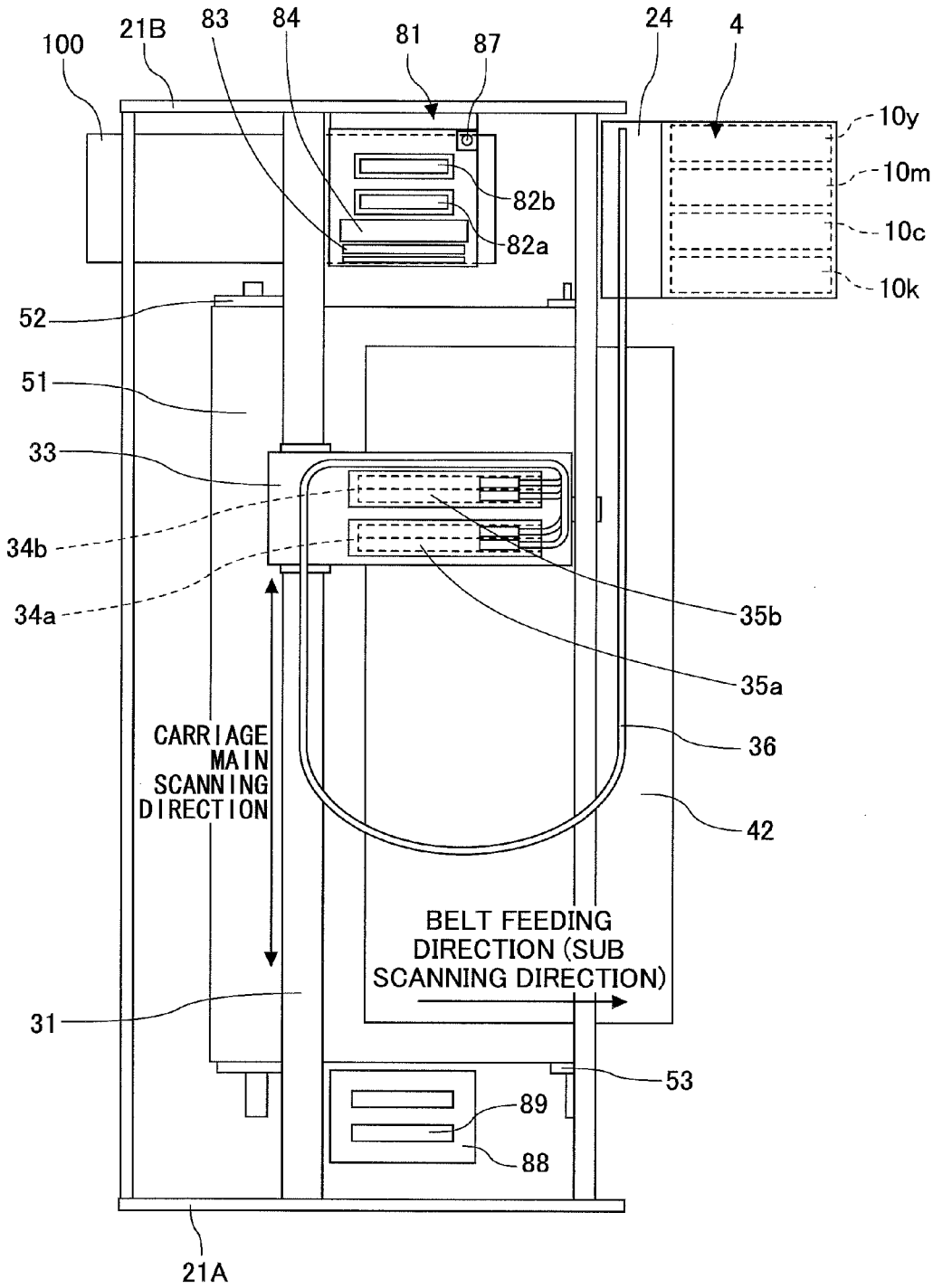
FIG. 2 is a top view of a main part of the mechanical part.

In the following, embodiments of the present invention are described with reference to the accompanying drawings. First, one example of an image forming apparatus according to an embodiment of the present invention is described with reference to FIGS. 1 and 2. FIG. 1 is a side view illustrating the entire configuration of the image forming apparatus. FIG. 2 is a top view of a main part of the apparatus of FIG. 1.

The image forming apparatus is a serial-type image forming apparatus. Namely, as illustrated in FIG. 2, a carriage 33 is slidably supported in the main scanning direction by a main guide rod 31 and a sub guide rod 32 which are guide members bridged between side plates 21A and 21B on the left and right sides, respectively, of an apparatus main body 1. As a result, the carriage 33 can move and scan in the carriage main scanning direction driven by a main-scanning motor and a timing belt (transfer belt) described below.

The carriage 33 includes recording heads 34*a* and 34*b* (which may be collectively referred to as "recording head 34") discharging ink droplets of yellow (Y), cyan (C), magenta (M), and black (K) colors and having a nozzle line that includes plural nozzles and that is arranged in the sub scanning direction orthogonal to the main scanning direction in a manner such that the ink discharging direction is directed downward.

The recording heads 34 have two nozzle lines, so that one nozzle line of the recording head 34*a* discharges black (K) liquid droplets and the other nozzle line of the recording head 34*a* discharges cyan (C) liquid droplets, and one nozzle line of the recording head 34*b* discharges magenta (M) liquid droplets and the other nozzle line of the recording head 34*b* discharges yellow (Y) liquid droplets.

Further, in the carriage 33, head tanks 35*a* and 35*b* (which may be collectively referred to as a "head tank 35") are mounted for supplying color inks corresponding to the nozzle lines of the recording heads 34. Color recording liquids are supplied from ink cartridges 10*y*, 10*m*, 10*c*, 10*k* (which may be collectively referred to as an "ink cartridge 10") to the respective head tanks 35 by a supply unit 24 via respective ink supply tubes 36. The ink cartridges 10 which are main tanks detachably mounted on a cartridge mounting section 4.

On the other hand, as a sheet feeding section for feeding a sheet 42 piled on a sheet piling section (platen plate) 41 of a sheet feeding tray 2, there are a half moon roller (feed roller) 43 and a separation pad 44. The half moon roller 43 separates and feeds the sheets 42 from the sheet piling section 41 one by one. The separation pad 44 faces the half moon roller 43 and is made of a material having a high friction coefficient. Further, the separation pad 44 is biased toward the half moon roller 43 side.

Further, in order to further feed the sheet 42 fed from the sheet feeding section to the lower side of the recording head 34, there are provided a guide member 45 guiding the sheet 42, a counter roller 46, a feed guide member 47, a pressing member 48 having a head pressing roller 49, and a transfer belt 51 which is a transmission unit that electrostatically attracts and feeds the sheet 42 to the side facing the recording head 34.

The transfer belt 51 is an endless belt bridged between a feed roller 52 and a tension roller 53, and rotates in the belt feeding direction (sub scanning direction). Further, there is provided a charging roller 56 serving as a charging unit charging a surface of the transfer belt 51. The charging roller 56 is in contact with a surface layer of the transfer belt 51, so that the charging roller 56 rotates in accordance with the rotation of the transfer belt 51.

The transfer belt 51 is rotated and moved in the belt feeding direction by the rotation of the feed roller 52 driven by a sub scanning motor described below via a timing belt.

Further, as a sheet discharging section for discharging the sheet 42 printed by the recording head 43, there are provided a separation pawl 61 to separate the sheet 42 from the transfer belt 51, a sheet discharging roller 62, a spur 63 which is another discharging roller, and a discharge tray 3 below the discharging roller 62.

Further, a two-sided unit 71 is detachably mounted on the rear part of the apparatus main body 1. The two-sided unit 71 takes in the sheet 42 returned by the rotation in the reverse direction of the transfer belt 51, reverses the sheet 42, and feeds the sheet 42 between the counter roller 46 and the transfer belt 51 again. Further, there is a manual tray 72 on the upper surface of the two-sided unit 71.

Further, in one non-printing area on one side of the scanning direction of the carriage 33, there is a maintenance and recovery mechanism 81 to maintain and recover the status of the nozzles on the recording head 34. The maintenance and recovery mechanism 81 includes cap members (hereinafter a "cap" or a "suction cap") 82*a* and 82*b* (which may be collectively referred to as "cap 82") to cap the nozzle surfaces of the recording head 34, a wiper member (wiper blade) 83 to wipe the nozzle surfaces, a preliminary discharge tray 84, and a carriage lock 87 to lock the carriage 33.

The preliminary discharge tray 84 receives droplets upon a preliminary discharge that preliminarily discharges thicker recording fluid and that makes no contribution to printing. Further, under the maintenance and recovery mechanism 81, a waste fluid tank 100 is exchangeably provided to the apparatus main body 1 to contain waste fluid produced by the maintenance and recovery operation.

Further, in another non-printing area on the other side of the scanning direction of the carriage 33, there is provided a preliminary discharge tray 88 to receive droplets upon the preliminary discharge that preliminarily discharges recording fluid having been made thicker during printing or the like and that makes no contribution to printing. The preliminary discharge tray 88 includes an opening 89 which is open along the nozzle line direction of the recording head 34.

In an image forming apparatus having the configuration described above, the sheets 42 are separated and fed from the feeding tray 2 one by one. Then, the sheet 42 fed substantially in the vertical upward direction is guided by the guide member 45, and further fed between the transfer belt 51 and the counter roller 46. Then, the header of the sheet 42 is further guided by a transfer guide 37 and pressed toward the transfer belt 51 by the head pressing roller 49 so that the transfer direction of the sheet 42 is changed by approximately 90 degrees.

Then, an alternating voltage alternately repeating a plus output and a minus output is applied to the charging roller 56. As a result the transfer belt 51 is alternately charged to have an alternating band voltage pattern in the sub scanning direction (i.e., the rotating direction) in a manner such that plus charges and minus charges are alternately charged and have a predetermined width.

When the sheet 42 is fed on the transfer belt 51 where plus charges and minus charges are alternately charged, the sheet 42 is attracted to the transfer belt 51 and fed in the sub scanning direction by the rotating movement of the transfer belt 51.

Then, by moving the carriage 33 and driving the recording head 34 in accordance with an image signal, ink droplets are discharged onto the halted sheet 42, so as to record one line of data. Then, the sheet 42 is fed by a predetermined distance and the data of the next line is recorded.

Upon receipt of a record end signal or a signal indicating the arrival of the tail of the sheet 42 at the recording area, the recording operation ends and the sheet 42 is discharged to the discharge tray 3.

On the other hand, to maintain and recover the nozzles of the recording head 34, the carriage 33 is moved to a home position so as to face the maintenance and recovery mechanism 81 and the capping by the cap member 82 is performed. Then, the maintenance and recovery operations such as the nozzle suction operation to suction through the nozzles and the preliminary discharge operation discharging liquid droplets making no contribution to image forming are performed. By doing in this way, it may become possible to stably form an image by discharging liquid droplets.

Figure 3:
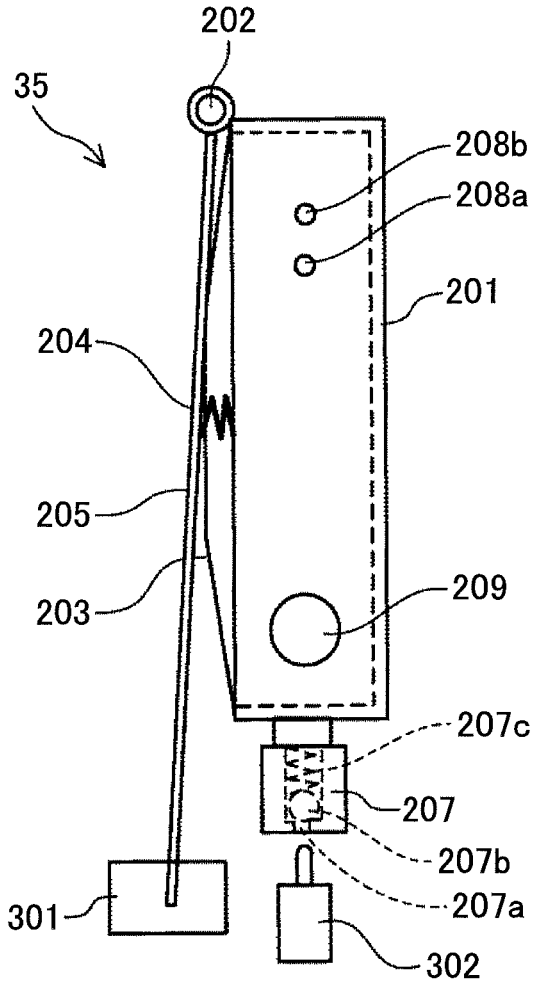
FIG. 3 is a schematic top view illustrating an example of a head tank.
Figure 4:
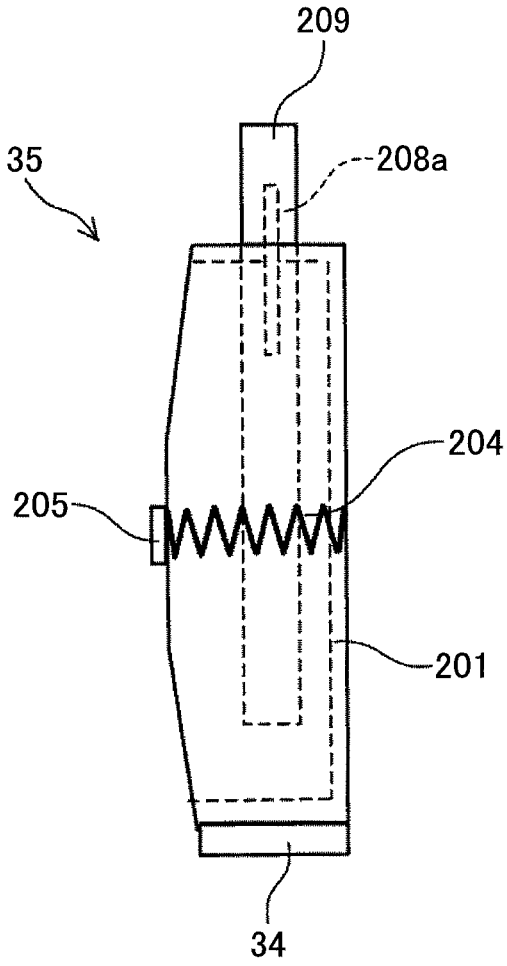
FIG. 4 is a schematic front view of the head tank of FIG. 3.

Next, an example of the head tank 35 is described with reference to FIGS. 3 and 4. FIGS. 3 and 4 are schematic top and front views, respectively, of the head tank 35 corresponding to one nozzle line.

The head tank 35 includes a tank case 201 forming (defining) (a part of) an ink container storing ink and having an opening on one side of the ink container. The opening of the tank case 201 is sealed by a flexible film 203. Further, a spring 204 as an elastic member is disposed in the tank case 201 so as to always bias the flexible film 203 toward outside. Due to the biasing force applied to the flexible film 203 of the tank case 201 toward outside by the spring 204, a negative pressure may be generated (increased) in response to a decrease of a remaining ink amount in the tank case 201.

Further, outside of the tank case 201, there is a displacement member 205 (hereinafter may be referred to as a "full-tank detection filler") that has one end side swingably supported by a supporting axle 202 and that is biased toward the tank case 201 side. The displacement member 205 is fixed onto the flexible film 203 with glue or the like, so that the displacement member 205 is displaced in accordance with the movement of the flexible film 203. By detecting the displacement member 205 using a full-tank detection sensor 301, it may become possible to detect the remaining ink amount in the head tank 35 and the like.

Further, on the upper side of the tank case 201, a supply opening 209 to supply ink from the ink cartridge 10 is formed and connected to the ink supply tube 36. Further, on one side part of the tank case 201, an air opening mechanism 207 to open the inside of the head tank 35 to the atmosphere is formed. The air opening mechanism 207 includes a valve body **207*b* to open and close an air opening path 207*a* in communication with the inside of the head tank 35 and a spring 207*c* biasing the valve body 207*b* so as to close the air opening path 207*a*. The air opening path 207*a* is open when an air opening solenoid 302 is used to press the valve body 207*b*, so that the inside of the head tank 35** is in communication with the atmosphere (air opened state).

Further, there are provided electrode pins **208*a* and 208*b* to detect an ink fluid surface height in the head tank 35. Ink is electrically conductive. Therefore, when ink is in contact with the electrode pins 208*a* and 208*b*, a current flows between the electrode pins 208*a* and 208*b*, thereby changing the resistance value between the electrode pins 208*a* and 208*b*. By using the characteristics, it may become possible to detect where the ink fluid surface height is equal to or lower than a predetermined height. Namely, it may become possible to determine whether an amount of air in the head tank 35** is equal to or greater than a predetermined amount.

Figure 5:
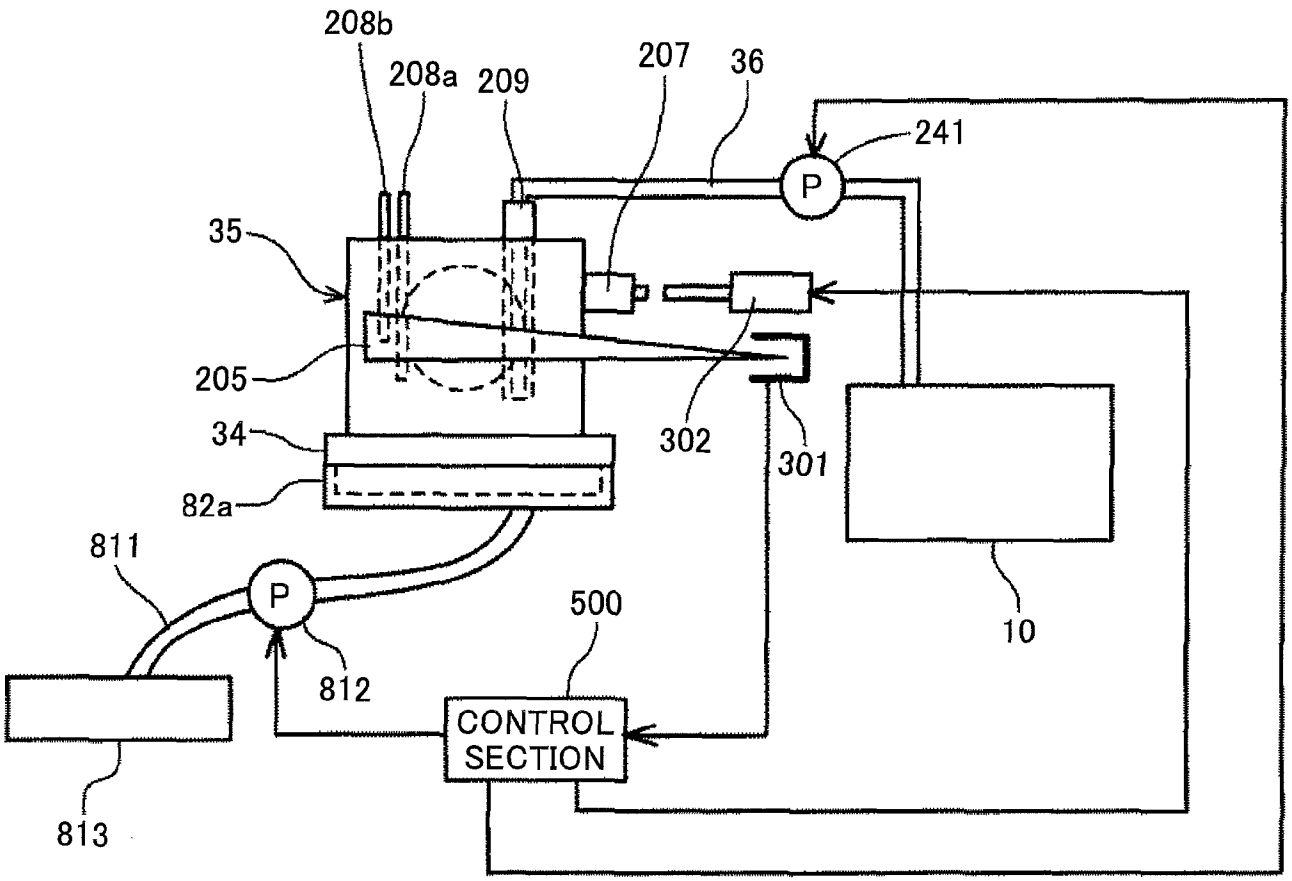
FIG. 5 is a schematic view illustrating an ink supply exhaust system.

Next, a negative pressure generating operation in the image forming apparatus is described with reference to FIG. 5 schematically illustrating the ink supply system of the image forming apparatus. First, there is a fluid supply pump 241 between the ink cartridge 10 and the head tank 35. The fluid supply pump 241 herein is a reversible-type pump (i.e., a pump capable of supplying and suctioning fluid) such as a tube pump.

While the air opening mechanism 207 of the head tank 35 is closed, the fluid supply pump 241 is reversely driven to supply ink from the head tank 35 to the ink cartridge 10 (hereinafter this operation may be called a "ink reverse supply" or "ink suction"). By doing this, due to the biasing force applied to the flexible film 203 toward outside by the spring (elastic member) 204, the negative pressure may be generated in the head tank 35.

Further, while the air opening mechanism 207 of the head tank 35 is closed, the nozzle surface of the recording head 34 is capped (sealed) by the cap members **82*a* of the maintenance and recovery mechanism 81 and a suction pump 812 of the maintenance and recovery mechanism 81** is driven.

Then, it may become possible to suction ink in the head tank 35 by suctioning ink from the nozzle of the recording head 34 via a suction tube 812. By doing this, due to the biasing force applied to the flexible film 203 toward outside by the elastic member 204, the negative pressure may be generated in the head tank 35. The suctioned waste ink is exhausted to a waste fluid tank 813.

Further, while the air opening mechanism 207 of the head tank 35 is closed, liquid droplets not contributing to image forming are discharged from the recording head 34 to the preliminary discharge tray 84 so as to consume ink in the head tank 35. Similar to the above, by ding this, due to the biasing force applied to the flexible film 203 toward outside by the elastic member 204, the negative pressure may be generated in the head tank 35.

Next, the detection of the negative pressure (pressure) in the head tank 35 is described with reference to FIG. 6 and FIGS. 7A and 7B.

Figure 6:
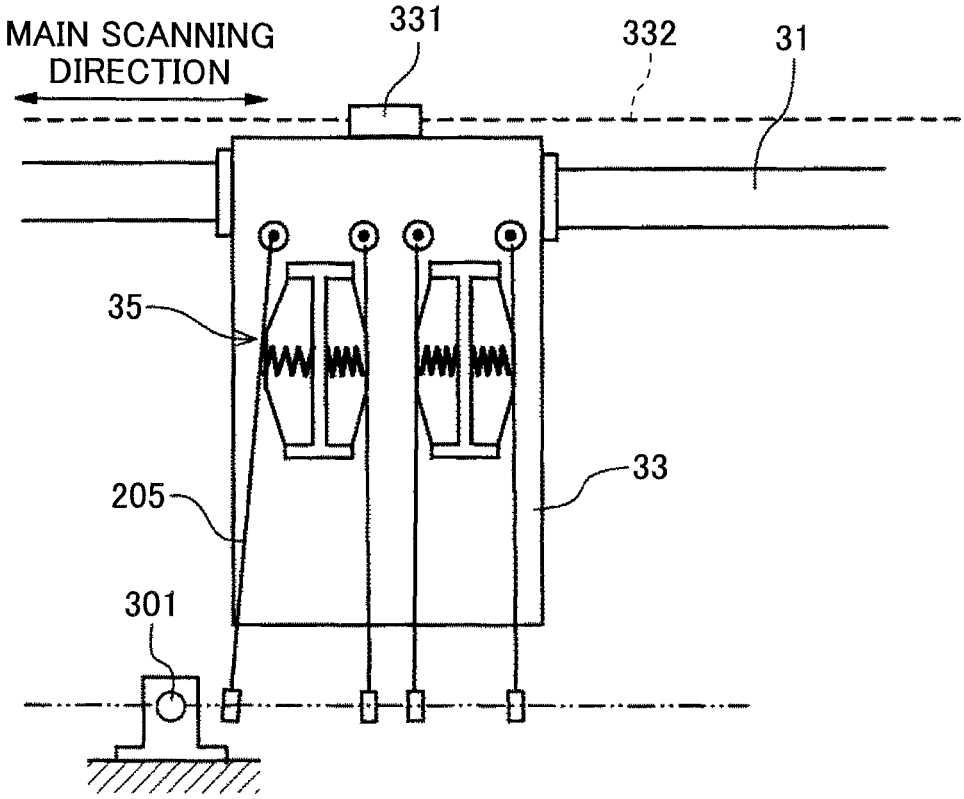
FIG. 6 is a view of a main part of the carriage and a full-tank detection sensor illustrating a pressure detection of the head tank.

As illustrated in FIG. 6, on the apparatus main body 1 side, the full-tank detection sensor 301 as a transmission-type optical sensor is disposed at the position where a distal end 205*a* of the displacement member 205 (full-tank detection filler) of the head tank 35 passes when the carriage 33 is moved in the main scanning direction. Herein, the position of the carriage 33 in the main scanning direction is detected by reading an encoder scale 332 arranged along the carriage main scanning direction using an encoder sensor 331 (FIG. 6).

Figure 7A:
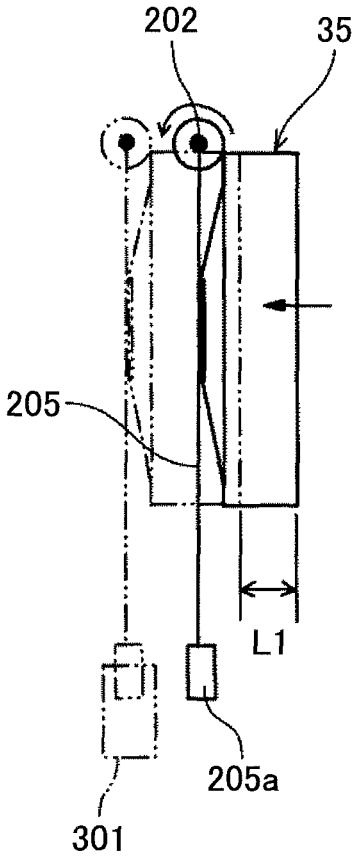
FIGS. 7A and 7B are schematic views illustrating the pressure detection of the head tank.
Figure 7B:
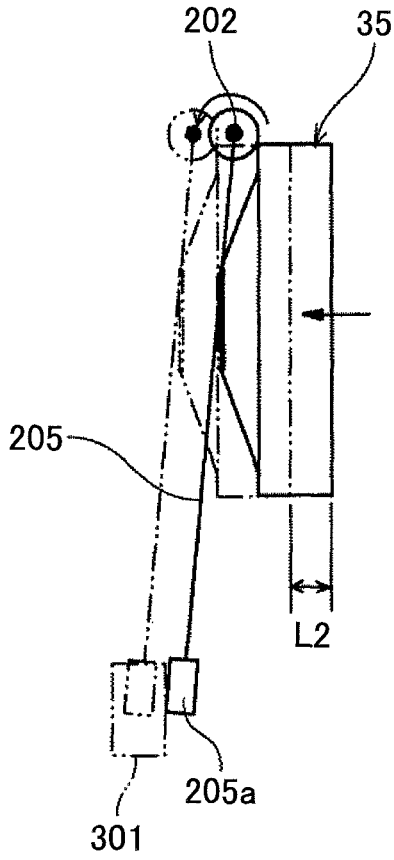

Therefore, as illustrated in FIG. 7A, when the negative pressure (pressure) value in the head tank 35 is normal, by moving the carriage 33 in the arrow direction from a predetermined position illustrated in solid lines so that the head tank 35 is moved by a distance L1, the full-tank detection sensor 301 may detect the distal end 205*a* of the displacement member 205.

On the other hand, as illustrated in FIG. 7A, when the negative pressure (pressure) value in the head tank 35 is not normal (i.e., abnormal) because the negative pressure in the head tank 35 is lower (i.e., the pressure in the head tank 35 is higher), the displacement member 205 that should be more shifted to the head tank 35 side is more separated from the head tank 35 (i.e., the displacement member 205 is more biased outward by the restoring force of the elastic member 20).

Because of this feature, when the carriage is similarly moved in the arrow direction from the predetermined position illustrated in the solid lines, the full-tank detection sensor 301 may detect the distal end 205*a* of the displacement member 205 when the head tank 35 is moved by a distance L2 which is less than the distance L1, the distance when the negative pressure in the head tank 35 is normal.

Similarly, when the negative pressure (pressure) value in the head tank 35 is not normal (i.e., abnormal) because the negative pressure in the head tank 35 is higher (i.e., the pressure in the head tank 35 is lower), the displacement member 205 that should be more separated from the head tank 35 side is more shifted to the head tank 35 (i.e., the displacement member 205 is pressed inward against the restoring force of the elastic member 20).

Because of this feature, when the carriage is similarly moved in the arrow direction from the predetermined position (i.e. the position in a normal value) illustrated in the solid lines, the full-tank detection sensor 301 may detect the distal end 205*a* of the displacement member 205 when the head tank 35 is moved by a distance greater than the distance L1, the distance when the negative pressure in the head tank 35 is normal.

As described above, by detecting the position (moving distance) of the head tank 35 when the distal end 205*a* of the displacement member 205 is detected, it may become possible to detect a displacement amount of the displacement member 205 (the displacement mount corresponding to the displacement amount of the elastic member 204 in the head tank 35), the pressure (negative pressure) in the head tank 35, and the ink remaining amount in the head tank 35 because the displacement member 205 is displaced in accordance with the ink remaining amount.

Next, an ink supply operation of supplying ink to the head tank 35 and an end detection of the ink cartridge 10 are described with reference to FIGS. 8A and 8B.

As described above, the displacement amount (open amount) of the displacement member 205 may be prescribed as the relative positional relationship of the carriage 33 relative to the full-tank detection sensor 301.

Figure 8A:
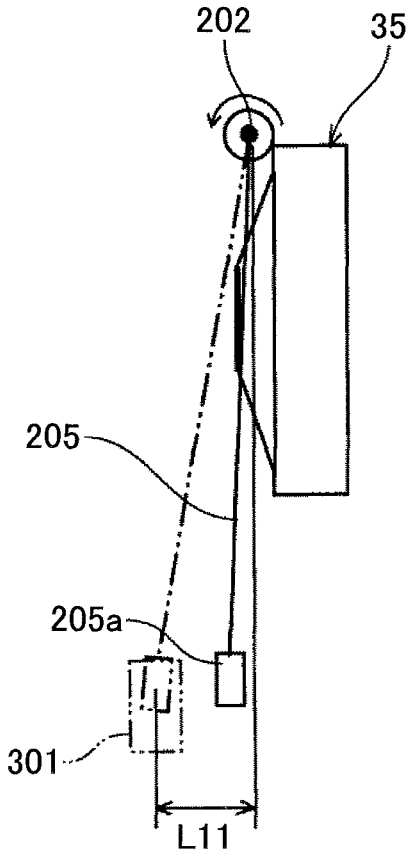
FIGS. 8A and 8B are schematic views illustrating an ink supply operation to the head tank and end detection of the ink cartridge.
Figure 8B:
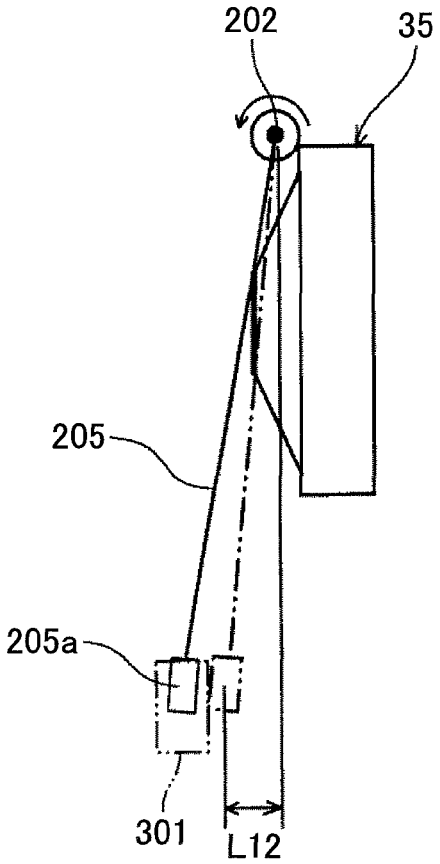

Namely, as illustrated in FIG. 8A, by supplying ink to the head tank 35 while the carriage 33 is disposed at a predetermined position relative to the full-tank detection sensor 301, the displacement member 205 is displaced with the increase of the ink amount in the head tank 35, and the full-tank detection sensor 301 may detect the displacement member 205.

In this case, it may be determined that the head tank 35 is full (full tank) at a timing when the open amount of the displacement member 205 becomes L11 by supplying a predetermined amount of ink to the head tank 35, and then the ink supply operation may stop.

Next, ink in the head tank 35 is consumed by discharging ink from the recording head 34, suctioning ink via the suction cap 82*a* and the like. As illustrated in FIG. 8B, the open amount of the displacement member 205 may become smaller to L12, for example. In this case, it may be determined (detected) that the head tank 35 is full at a timing when a counted value determined based on the counted discharge amount and the counted suction amount via the suction cap 82*a* becomes a predetermined amount.

Otherwise, the ink supply operation may be performed by detecting the open amount L12 of the displacement member 205. Namely, by the control so that the open amount of the displacement member 205 is in a range between L11 and L12, an appropriate negative pressure for discharging a liquid (ink) may be maintained.

As described above, in a normal use condition, the ink (liquid) supply operation is intermittently repeated so that the open amount of the displacement member 205 is in the range between L11 and L12.

On the other hand, when the full-tank detection sensor 301 does not detect the displacement member 205 even when the ink supply operation described with reference to FIG. 8A is performed for a predetermined time period, it may be determined that there is no ink in the ink cartridge 10. It may also be possible to determine the cartridge end (i.e., no ink remaining in the cartridge) by calculating the ink remaining amount in the ink cartridge 10 by counting the discharge amount of ink from the recording head 34.

When this method is used, however, an error between the amount based on the counted value and the actual remaining amount may occur. Due to the error, it may be necessary to determine the cartridge end in advance even when it is detected that a predetermined amount of ink still remains. On the other hand, by using the method that the cartridge end is determined when the displacement member 205 is not detected within the predetermined time period, it may become possible to more certainly use ink until the cartridge end of the cartridge 10, thereby enabling using ink more economically.

Figure 9:
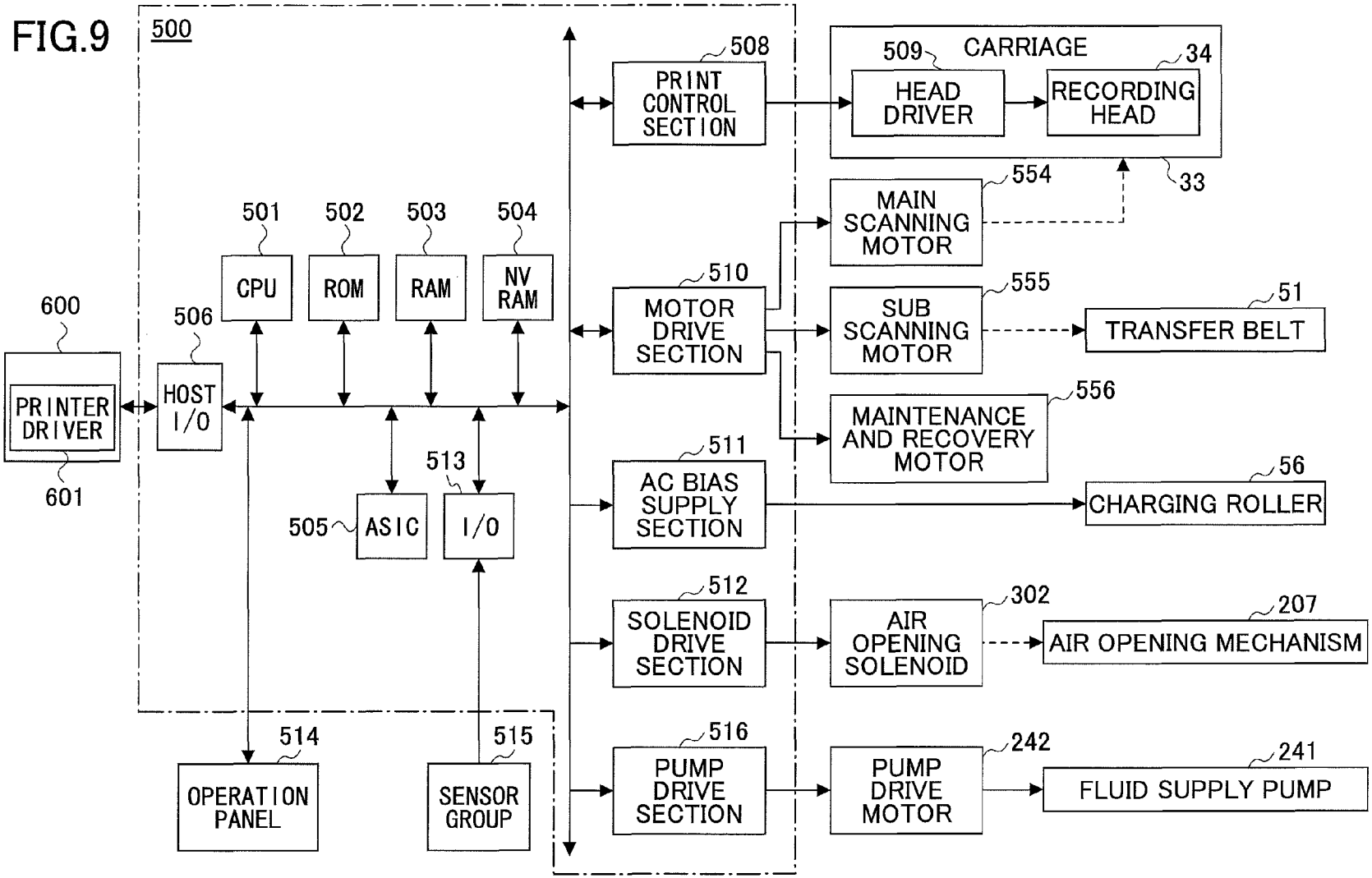
FIG. 9 is a schematic block diagram illustrating a control section.

Next, the outline of the control section 500 of the image forming apparatus is described with reference to FIG. 9. FIG. 9 is a schematic block diagram of the control section 500.

As illustrated in FIG. 9, the control section 500 includes a CPU (Central Processing Unit) 501, a ROM (Read Only Memory) 502, a RAM (Random Access Memory) 503, a rewritable non-volatile memory 504, and an ASIC (Application Specific Integrated Circuit) 505. The CPU 501 performs control of the entire apparatus. The ROM 502 stores programs including programs and other fixed data, the programs including a program performing control (processes) according to the present invention and executed by the CPU 501.

The RAM 503 temporarily stores image data and the like. The non-volatile memory 504 is provided for storing data even when the power of the apparatus is turned OFF. The ASIC 505 performs various signal processing operations on image data, image processing such as a process of changing the order of data, and processing on input and output signals to control the entire apparatus and the like.

The control section 500 further includes a print control section 508, a head driver (driver IC) 509, a motor drive section 510, an AC bias supply section 511, a solenoid drive section 512, a pump drive section 516 and the like. The print control section 508 includes a data transfer unit and a drive signal generation unit to drive and control the recording head 34.

The motor drive section 510 drives a head driver (driver IC) 509 to drive the recording head 34 provided on the carriage 33 side, a main scanning motor 554 to move and scan the carriage 33, a sub scanning motor 555 to rotate and move the transfer belt 51, and a maintenance and recovery motor 556 of the maintenance and recovery mechanism 81.

The AC bias supply section 511 supplies an AC bias to the charging roller 56. The solenoid drive section 512 drives the air opening solenoid 302 to open and close the air opening mechanism 207 of the head tank 35. The pump drive section 516 drives the fluid supply pump 241.

Further, the control section 500 is connected to an operation panel 514 displaying information necessary for the apparatus and accepting the input of the information.

The control section 500 further includes a host interface ("I/F") 506 for transmitting and receiving data and signals from and to a host side, so that the I/F 506 of the control section 500 receives the data and the signals from a host 600 including an image processing apparatus such as a personal computer, an image reading apparatus such as an image scanner, an image acquisition apparatus such as a digital camera and the like via a cable or a network.

Further, the CPU 501 of the control section 500 reads and analyzes the print data in a receiving buffer of the I/F 506. The ASIC 505 performs a process of changing the order of the data and the like, and the image data are transferred from the print control section 508 to the head driver 509. Further, the dot pattern data for the image output are generated by a printer drive 601 on the host 600 side.

The print control section 508 transfers the image data as serial data, and outputs the transfer clock signal, the latch signal, the control signal and the like necessary for the transfer of the image data and the confirmation of the transfer. Further, the print control section 508 includes a D/A converter to perform D/A conversion on the pattern data of driving pulses stored in the ROM 502, a voltage amplifier, and a drive signal generator including a current amplifier, and outputs a drive signal including one or more drive pulses to the head driver 509.

The head driver 509 drives the recording head 34 by applying a drive pulse of the drive signal to a drive element (e.g., piezoelectric device), the drive signal being given from the print control section 508 based on the image data corresponding to one line of the recording head 34 and being input in series, the drive element generating energy for selectively discharging liquid droplets from the recording head 34.

In this case, by selecting the drive pulse of the drive signal, it becomes possible to select different sizes of dots such as large droplets, middle-sized droplets, and small droplets to be discharged.

An I/O section 513 (of the control section 500) acquires information from a sensor group 515 mounted in the apparatus and extracts information necessary for controlling the printer, so that the extracted information is used in, for example, the print control section 508, the motor drive section 510, and the control of the AC bias supply section 511.

The sensor group 515 includes, for example, an optical sensor to detect the position of the sheet, a thermistor to monitor the temperature and the humidity in the apparatus, a sensor monitoring a voltage of a charged belt, and an interlock switch detecting the opening/closing the cover. The I/O section 513 can process various sensor information. The sensor group 515 includes the full-tank detection sensor 301 detecting the displacement member 205 of the head tank 35, and the electrode pins 208*a* and 208*b*.

The CPU 501 of the control section 500 serves as (constitutes) a unit to detect the pressure in the head tank 35 by detecting the displacement member 205 based on the detection signal from the full-tank detection sensor 301. Further, the CPU 501 constitutes a unit (herein may be referred to as first or third control unit and the like) that controls ink liquid flow between the ink cartridge 10 and the head tank 35.

Next, a first embodiment of the present invention is described.

First, as described above, when the ink-end condition (i.e., the ink-empty condition) of the ink cartridge is detected (determined), the exchange of the empty ink cartridge 10 with a new ink cartridge 10 is suggested to the user.

In this case, even after the ink cartridge 10 is empty (end), if the fluid supply pump 241 is driven to supply ink from the ink cartridge 10 to the head tank 35 side, the fluid supply path between the fluid supply pump 241 and the ink cartridge 10 may become a vacuum state. Even after the fluid supply pump 241 is stopped, due to the valve mechanism of the fluid supply pump 241, the vacuum state may be maintained.

Under the state, if the ink cartridge 10 is exchanged, air may be introduced into the fluid supply path in the vacuum state right after the ink cartridge 10 is removed. After that, if a new ink cartridge 10 is attached and ink is supplied to the head tank 35, the introduced air may also be transferred to the head tank 35.

As a result, air in the head tank 35 may be formed as air bubbles, which may cause a malfunction in the detection using the electrode pins 208. Further, due to the increase of the air amount, the ink amount may be relatively reduced.

To respond to the problem, when the ink cartridge is in the ink-end (ink-empty) condition, before suggesting the exchange of the ink cartridge 10 to the user, the negative pressure of the fluid supply path in the vacuum state between the ink cartridge 10 and the fluid supply pump 241 is released.

To that end, when the full-tank detection sensor 301 does not detect the displacement member 205 of the head tank 35 within a predetermined time period since the fluid supply pump 241 is driven, the fluid supply pump 241 is stopped. Then, the fluid supply pump 241 is reversely driven to return (supply) a small amount of ink from the head tank 35 to the ink cartridge 10 side to release the negative pressure of the fluid supply path in the vacuum state. Then, the fluid supply pump 241 is stopped.

Then, after the vacuum state is released, the exchange of the empty ink cartridge 10 with a new ink cartridge 10 may be suggested to the user on the display of the operation panel 514 or the like.

Normally, the user may exchange the ink cartridge 10 under this state. However, there may be case where there are no new ink cartridges 10 or the user wishes to continue printing a little bit more. In such a case, ink remaining in the head tank 35 is not sufficient, so that the head tank 35 is in a negative pressure state.

Namely, it may be possible to continue printing for a while but as the printing is continued, the volume of the head tank 35 may be reduced and the negative pressure in the head tank 35 may be increased. When the negative pressure becomes higher, air may be suctioned through the nozzles of the recording head 34, which may cause an unstable discharging condition.

Specifically, when it is determined that the ink cartridge 10 is in the ink-end condition, the open amount of the displacement member 205 of the head tank is an arbitrary amount in the range between L11 and L12 which is described above with reference to FIGS. 8A and 8B. Under this state, when the printing is continued, the open amount of the displacement member 205 may be less than the open amount L12.

As the result, the negative pressure may be increased too much and air may be more likely to be suctioned through the nozzles of the recording head 34. In other words, in a case where the open amount of the displacement member 205 is close to the open amount L12 at the timing when it is determined that the ink cartridge is in the ink-end condition, if the printing is continued, the quality of the output image may be immediately degraded.

In respond to the problem, in this embodiment, in a case where, even when the fluid supply pump 241 (which may be herein referred to as a "reversible-type fluid supply unit") is used to perform the fluid supply for a predetermined time period, if the pressure in the head tank 35 is not restored to a predetermined pressure, it is determined that the ink cartridge 10 (which is the main tank) is in the ink-end condition.

As a result, printing is stopped and the exchange of the ink cartridge 10 is suggested to the user. In this case, however, if the user wishes to continue printing, a printing mode is changed to an emergency printing mode, namely emergency printing is performed. In the emergency printing, the air opening mechanism 207 of the head tank 35 is opened to increase the pressure which is temporarily increased.

After that, the fluid supply pump 241 is reversely driven (controlled) to return (reversely supply) ink from the head tank 35 to the ink cartridge (main tank) 10 to reduce the pressure in the head tank 35 (the negative pressure is generated) to a desired pressure.

Next, the control in this embodiment is described with reference to the flowcharts of FIGS. 11 and 12.

First, during printing, it is determined whether a predetermined amount of ink in the head tank 35 is consumed (step S1, hereinafter step numbers are simplified as "S1" for instance). When determining that the predetermined amount of ink is consumed, the ink supply operation supplying a predetermined amount of ink is started (S2).

Then, the open amount of the displacement member 205 (hereinafter may be simplified as a "lever") in response to the predetermined amount is confirmed (checked) (S3). Then, the data of the open amount of the lever is referred to, the data having been stored in the ROM 502, and the open amount of the lever in response to the predetermined amount (i.e., a target supply amount) is determined (S4).

Then, the, the fluid supply pump 241 is normally driven to supply ink from the ink cartridge (main tank) 10 to the head tank 35 (S5). In this case, it is determined whether the target supply amount of ink has been supplied (i.e., as described above, it is determined whether the full-tank detection sensor 301 detects the lever) within the predetermined time period (S6, S9).

When determining that the full-tank detection sensor 301 detects the lever, since it means that the supply of the target supply amount of ink has been completed, the fluid supply pump 241 is stopped to stop the ink supply (S7), the ink supply operation of the predetermined amount of ink is stopped (S8), and printing is continues.

On the other hand, it is determined that, even when the fluid supply pump 241 is normally driven to supply ink from the ink cartridge (main tank) 10 to the head tank 35, if the full-tank detection sensor 301 does not detect the lever within the predetermined time period, it is determined that the ink cartridge 10 is in the ink-end condition, and the fluid supply pump 241 is stopped to stop the ink supply (S10).

Then, the fluid supply pump 241 is reversely driven to return (reversely supply) a predetermined amount of ink from the head tank 35 to the ink cartridge (main tank) 10 (S11). The "predetermined amount" may not be accurately determined as long as the "predetermined amount" at least corresponds to the capacity defined between the pressure cutting portion of the fluid supply pump 241 and the ink supply port (needle) of the ink cartridge 10.

In this case, the reversely supplied amount may be detected (determined) based on, for example, the time period of driving the fluid supply pump 241 or the number of rotations of the fluid supply pump 241 to supply ink.

After that, the state (e.g., a message) indicating that the ink cartridge 10 is in the ink-end condition (the state of the cartridge end) is displayed, and the operation of the apparatus is stopped (S12). In this case, the instructions to select either "cartridge exchange" or "emergency printing" are displayed on the operation panel or on the display device of the host 600 side for the user (S13).

When the "cartridge exchange" is selected (instructed), after the old ink cartridge is exchanged (replaced) by a new ink cartridge 10, the ink supply operation (not shown) of supplying ink from the new ink cartridge 10 to the head tank 35 is performed (S4).

Figure 10:
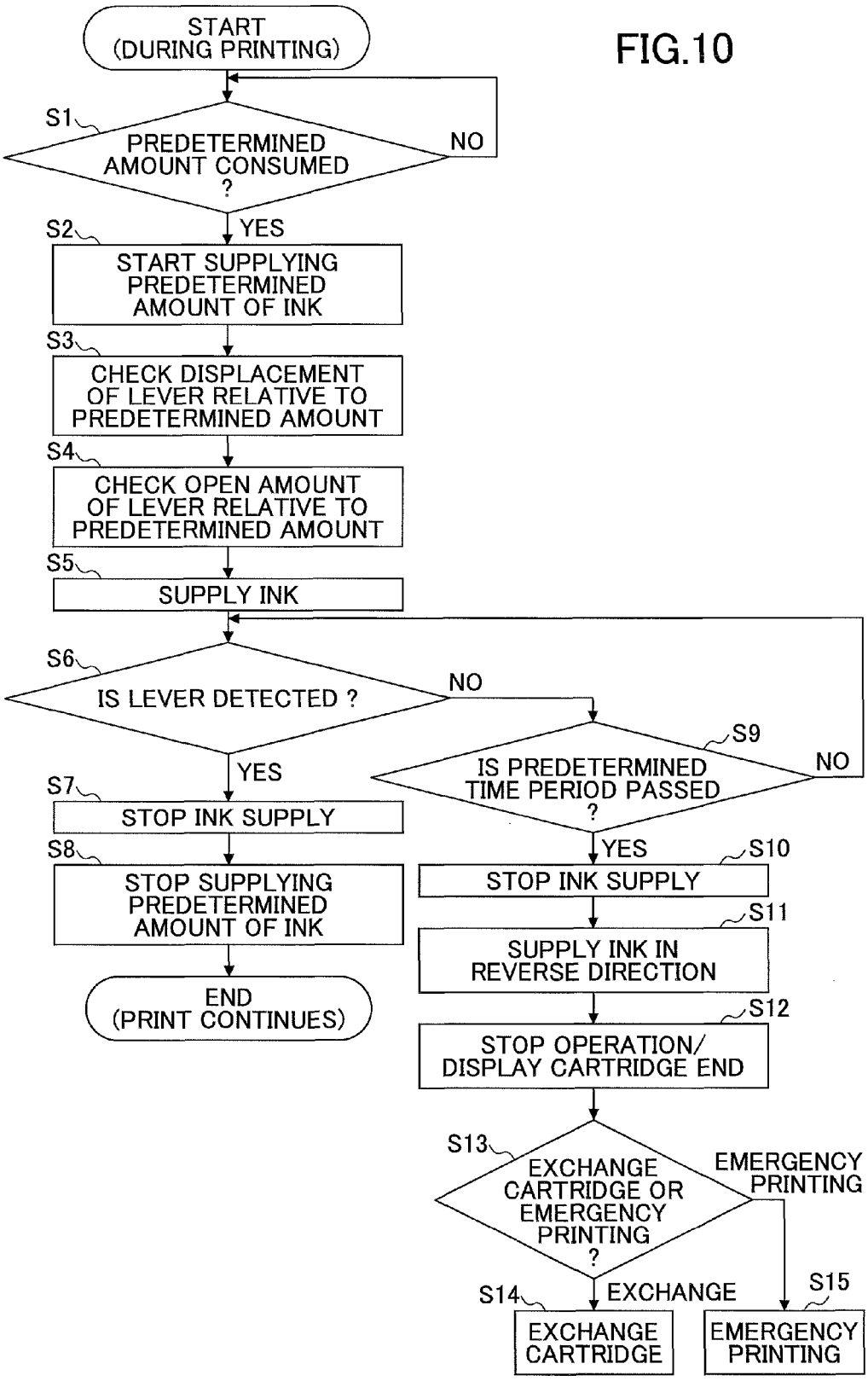
FIG. 10 is a flowchart illustrating the control according to a first embodiment of the present invention.

On the other hand, when the "emergency printing" is selected (instructed), the process goes to step S15 to perform the emergency printing operation illustrated in FIG. 10 (S15).

Next, the emergency printing operation is described with reference to FIG. 11. First, by normally driving the fluid supply pump 241, the ink having been reversely supplied from the head tank 35 to the ink cartridge 10 as described above is supplied from the ink cartridge 10 to the head tank 35 (S21).

In this case as well, the ink supply operation is stopped (i.e., the ink supply operation is stopped) by stopping the fluid supply pump 241 when, for example, the driving (supplying) time period or the number of the rotations of the fluid supply pump 241 is equal to the predetermined driving (supplying) time period or the number of the rotations, respectively (S22).

At this point, the ink amount in the head tank 35 is substantially equal to the ink amount before ink is reversely supplied from the head tank 35 to the ink cartridge 10, and the open amount of the lever (displacement member 205) is in a range between L11 and L12 of FIG. 8.

After that, the air opening mechanism 207 of the head tank 35 is opened (S23). By doing this, the air is introduced into the head tank 35 and the negative pressure is released and the open amount of the lever is greater than the open amount L11 of FIG. 8. After that, the air opening mechanism 207 of the head tank 35 is closed (S24).

Then, the fluid supply pump 241 is reversely driven to return (reversely supply) a predetermined amount of ink from the head tank 35 to the ink cartridge (main tank) 10 (S25). The "predetermined amount" refers to the amount so that appropriate negative pressure is generated in the head tank 35 and preferably the open amount of the lever (displacement member 205) is close to the open amount L11 of FIG. 8. From that point of view, the operating (driving) time period of the fluid supply pump 241 may be set by detecting the lever or may be determined in advance.

By doing this, an appropriate negative pressure may be generated in the head tank 35 and the vacuum state in the path from the fluid supply pump 241 to the ink cartridge 10 may be released.

After that, the ink consumption counter value is reset (S26). This is performed in order to perform the process, described with reference to FIG. 10, in which ink is supplied from the ink cartridge 10 to the head tank 35 when the estimated ink consumption amount (e.g., accumulated amount of the number of droplets or drops) in the head tank 35 is equal to the corresponding threshold value in normal printing. Namely, the counter is reset because the negative pressure in the head tank 35 is set to the initial value.

Then, the emergency printing is executed (S27). In this case, a normal printing operation is performed.

In this case, based on the counter value of the ink consumption counter, it is determined whether the open amount of the lever (displacement member 205) is equal to the open amount L12 of FIG. 8 (S28). When the counter value of the ink consumption counter is a predetermined value, the printing is stopped and the state of the cartridge end is displayed (S29).

AS described above, an image forming apparatus according to the embodiment includes a first control unit, when the pressure in the head tank is not restored to a predetermined pressure while liquid is supplied from the main tank to the head tank, determining that the state of the main tank is an empty state, cause the reversible-type fluid supply unit to reversely rotate to reversely supply a predetermined amount of liquid from the head tank to the main tank, and stop printing; and a second control unit, when the printing is stopped by the first control unit and emergency printing is instructed using liquid remaining in the image forming apparatus, causing the air opening mechanism of the head tank to open, causing the reversible-type fluid supply unit to normally rotate to supply the liquid to the head tank, the liquid having been reversely supplied to the main tank, causing the air opening mechanism to close, and causing the reversible-type fluid supply unit to reversely rotate to reversely supply the liquid from the head tank to the main tank to generate a predetermined negative pressure in the head tank.

By having this configuration, it may become possible to reduce ink to be wastefully consumed in the printing operation using the liquid (ink) remaining in the head tank.

In this embodiment, a case is described where the second control unit, when the printing is stopped by the first control unit and emergency printing is instructed using liquid remaining in the image forming apparatus, causes the air opening mechanism of the head tank to open, causes the reversible-type fluid supply unit to normally rotate to the supply liquid to the head tank, the liquid having been reversely supplied to the main tank, causes the air opening mechanism to close, and causes the reversible-type fluid supply unit to reversely rotate to reversely supply the liquid from the head tank to the main tank to generate a predetermined negative pressure in the head tank.

However, when the printing is stopped by the first control unit and emergency printing is instructed using liquid remaining in the image forming apparatus, the second control unit may cause the reversible-type fluid supply unit to normally rotate to supply the liquid to the head tank, the liquid having been reversely supplied to the main tank, cause the air opening mechanism of the head tank to open, cause the air opening mechanism to close, and cause the reversible-type fluid supply unit to reversely rotate to reversely supply the liquid from the head tank to the main tank to generate a predetermined negative pressure in the head tank.

Next, the control according a second embodiment of the present invention is described with reference to flowcharts of FIGS. 12 and 13.

In the above first embodiment, when the cartridge end is determined (i.e., when the full-tank detection sensor 301 does not detect the lever within the predetermined time period,) the fluid supply pump 241 is reversely driven to return (reversely supply) the predetermined amount of ink from the head tank 35 to the ink cartridge 10 to release the vacuum state of the supply path between the fluid supply pump 241 and the ink cartridge (S11).

Then, the state of the cartridge end is displayed and operating of the device is stopped. In this second embodiment, however, the state of the cartridge end is displayed and operating of the device is stopped without reversely supplying ink from the head tank 35 to the ink cartridge 10.

After that, when the user selects the "cartridge exchange", after the fluid supply pump 241 is reversely driven to reversely supply ink from the head tank 35 to the ink cartridge 10 to release the vacuum state of the supply path between the fluid supply pump 241 and the ink cartridge 10 (S16), the cartridge is exchanged (S14).

Figure 11:
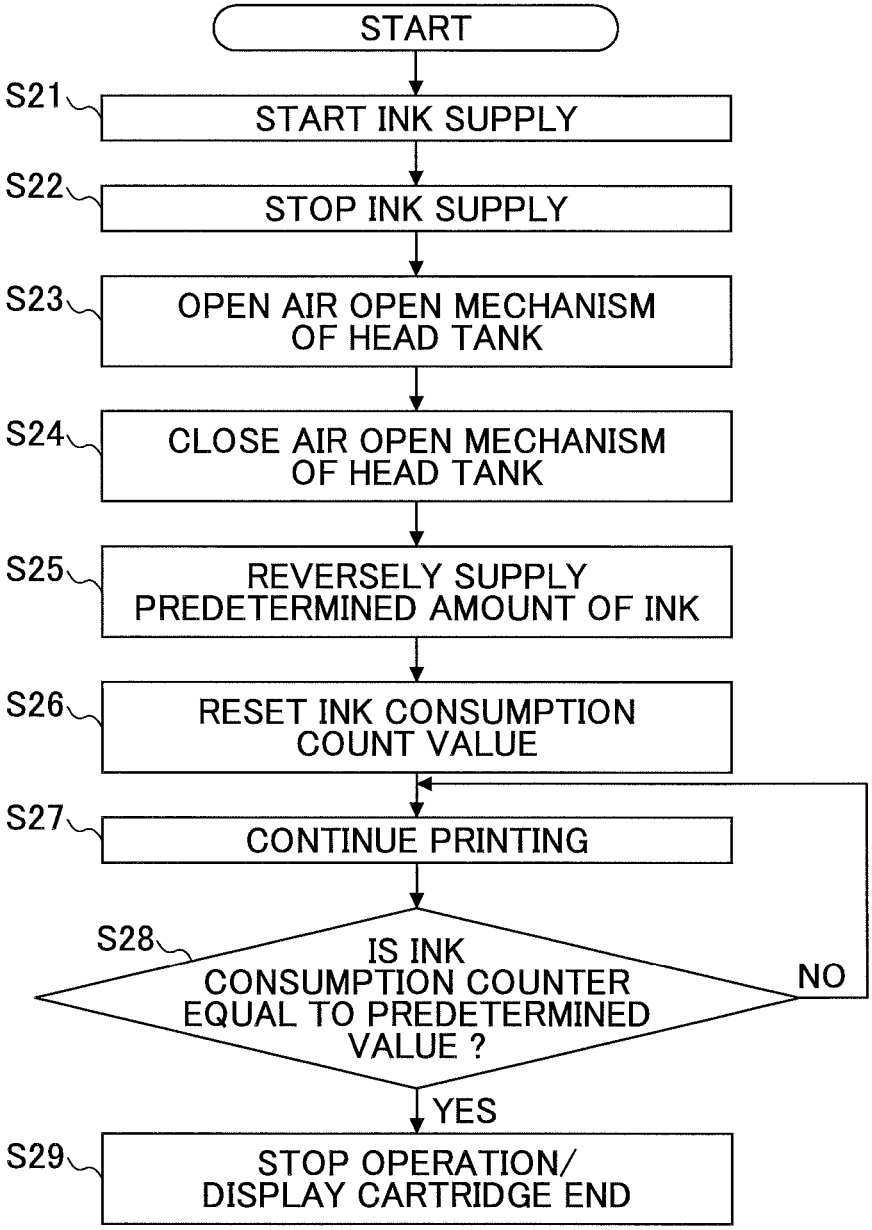
FIG. 11 is a flowchart illustrating the emergency printing in FIG. 10.
Figure 12:
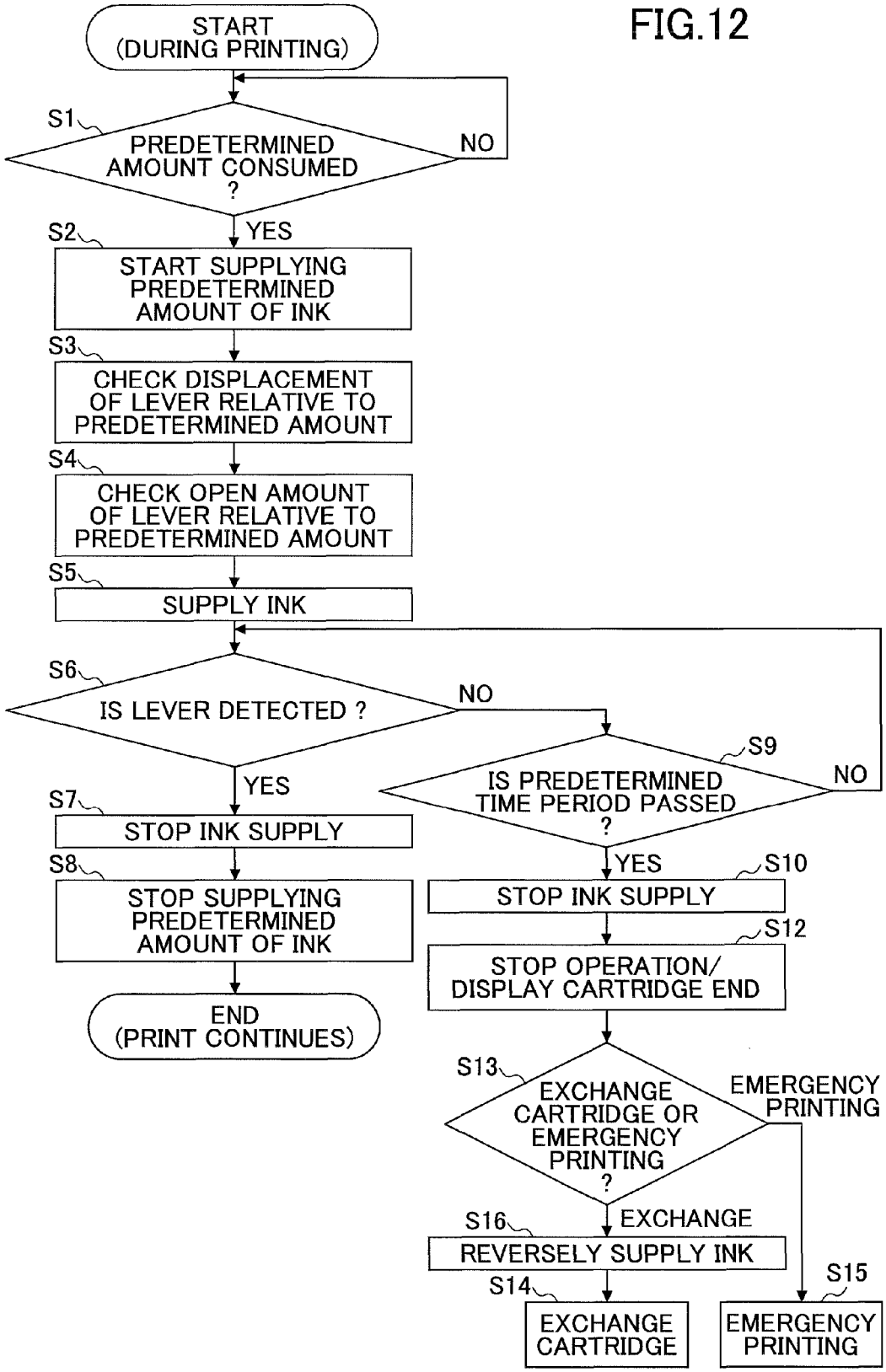
FIG. 12 is a flowchart illustrating the control according to a second embodiment of the present invention.
Figure 13:
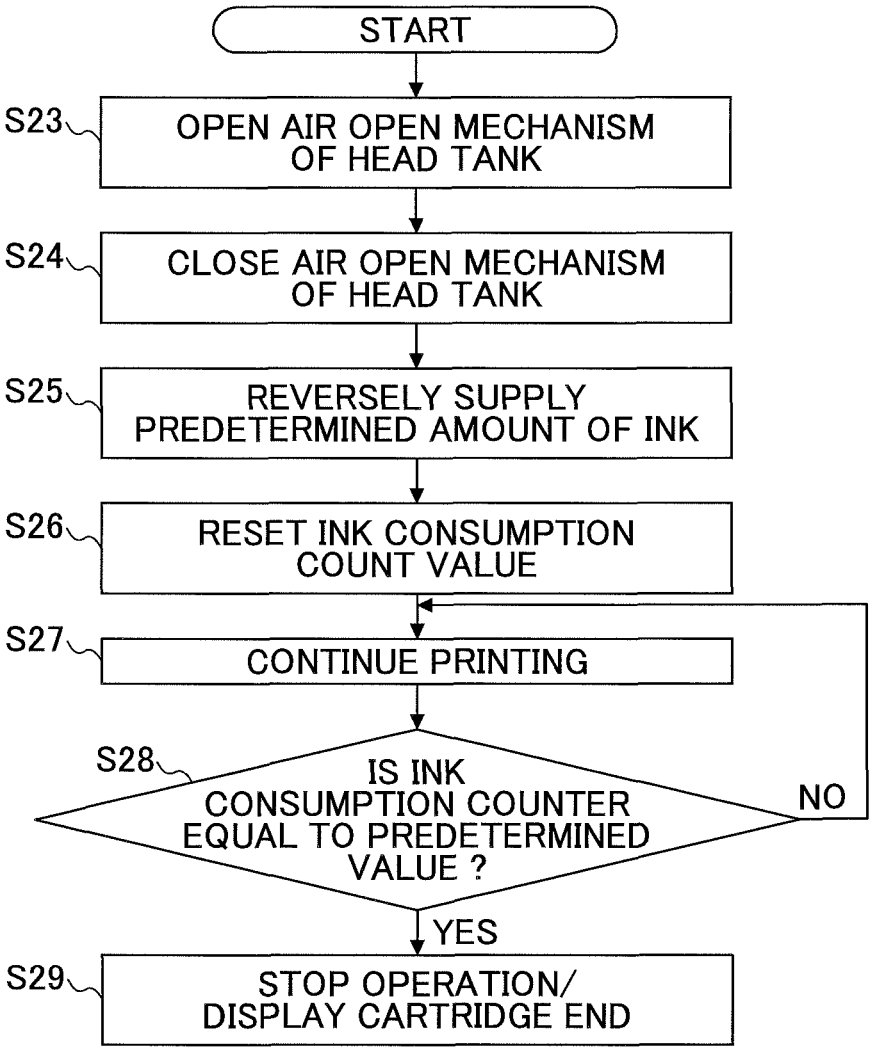
FIG. 13 is a flowchart illustrating the emergency printing in FIG. 12.

When the user selects the "emergency printing", as illustrated in FIG. 13, the process starts with the process to open the air opening mechanism 207 of the head tank 35 (i.e., the process starts with the process in step S23 of FIG. 11).

Unlike the first embodiment, when the "emergency printing" is instructed (directed) by the user, it may become possible to immediately start the negative pressure generation process by opening the air opening mechanism 207 of the head tank 35 because of skipping the process of reversely supply ink from the head tank 35 to the ink cartridge 10.

Figure 14:
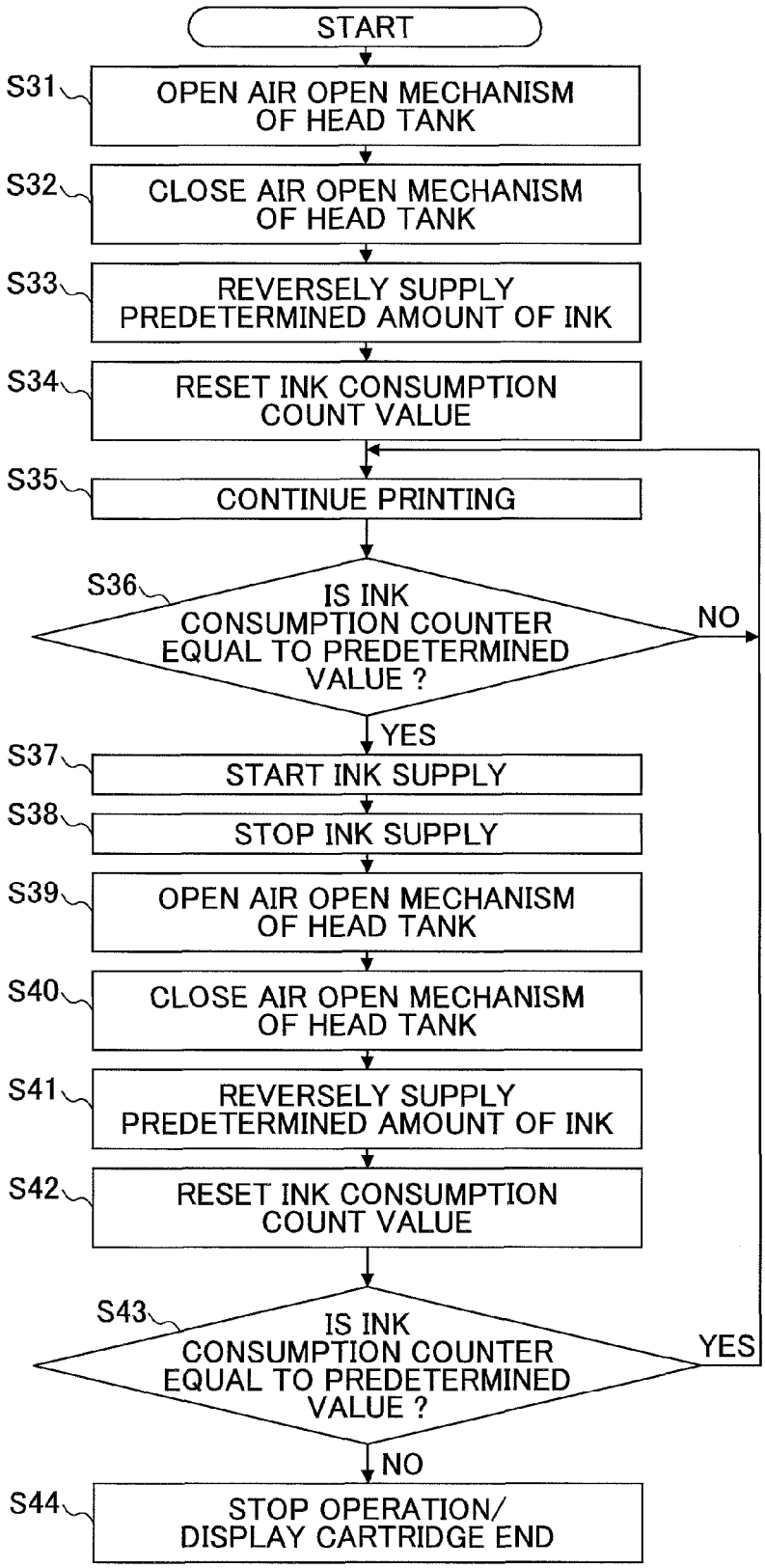
FIG. 14 is a flowchart illustrating the emergency printing in the control according to a third embodiment of the present invention.

Next, the control according a third embodiment of the present invention is described with reference to a flowchart of FIG. 14. FIG. 14 illustrates another example of the emergency printing when the "emergency printing" is selected in S13 of the first embodiment.

In this embodiment, as described in the first embodiment, after the fluid supply pump 241 is reversely driven to return (reversely supply) the predetermined amount of ink from the head tank 35 to the ink cartridge 10 to release the vacuum state of the supply path between the fluid supply pump 241 and the ink cartridge (S11 of FIG. 10), the air opening mechanism 207 of the head tank 35 is opened to introduce air into the head tank 35 to release the negative pressure (S31).

Then, the air opening mechanism 207 of the head tank 35 is closed (S32). Then, to generate negative pressure in the head tank 35, the fluid supply pump 241 is reversely driven to return (reversely supply) a predetermined amount of ink from the head tank 35 to the ink cartridge 10 side (S33). By doing this, the ink cartridge 10 side includes ink that has been reversely supplied twice.

Then, after the ink consumption counter value is reset (S34), the emergency printing is performed (S35). When it is determined that the ink consumption counter value is a predetermined counter value and the negative pressure in the head tank 35 approaches a limit value (S36), ink having been returned to the ink cartridge 10 side is supplied to the head tank 35 again (S37, S38).

Then, after the air opening mechanism 207 of the head tank 35 is temporarily opened to release the negative pressure (S39), the air opening mechanism 207 of the head tank 35 is closed again (S40) to generate negative pressure. Then, a predetermined amount of ink is reversely supplied to release the vacuum state in the supply path from the fluid supply pump 241 to the ink cartridge 10 side (S41).

By doing this, it may become possible to set the negative pressure of the head tank 35 to be the initial value again, so that the emergency printing can be performed again. Namely, it may become possible to multiply (increase) the number of printed sheets after the cartridge end is detected (displayed).

Then, the ink consumption counter value is reset (S42), and it is determined that the ink consumption counter value is the predetermined counter value and the negative pressure in the head tank 35 approaches the limit value (S43). When determined so, the state of the cartridge end is displayed and the operation of the apparatus is stopped (S44).

Next, the control according a fourth embodiment of the present invention is described with reference to a flowchart of FIG. 15.

Figure 15:
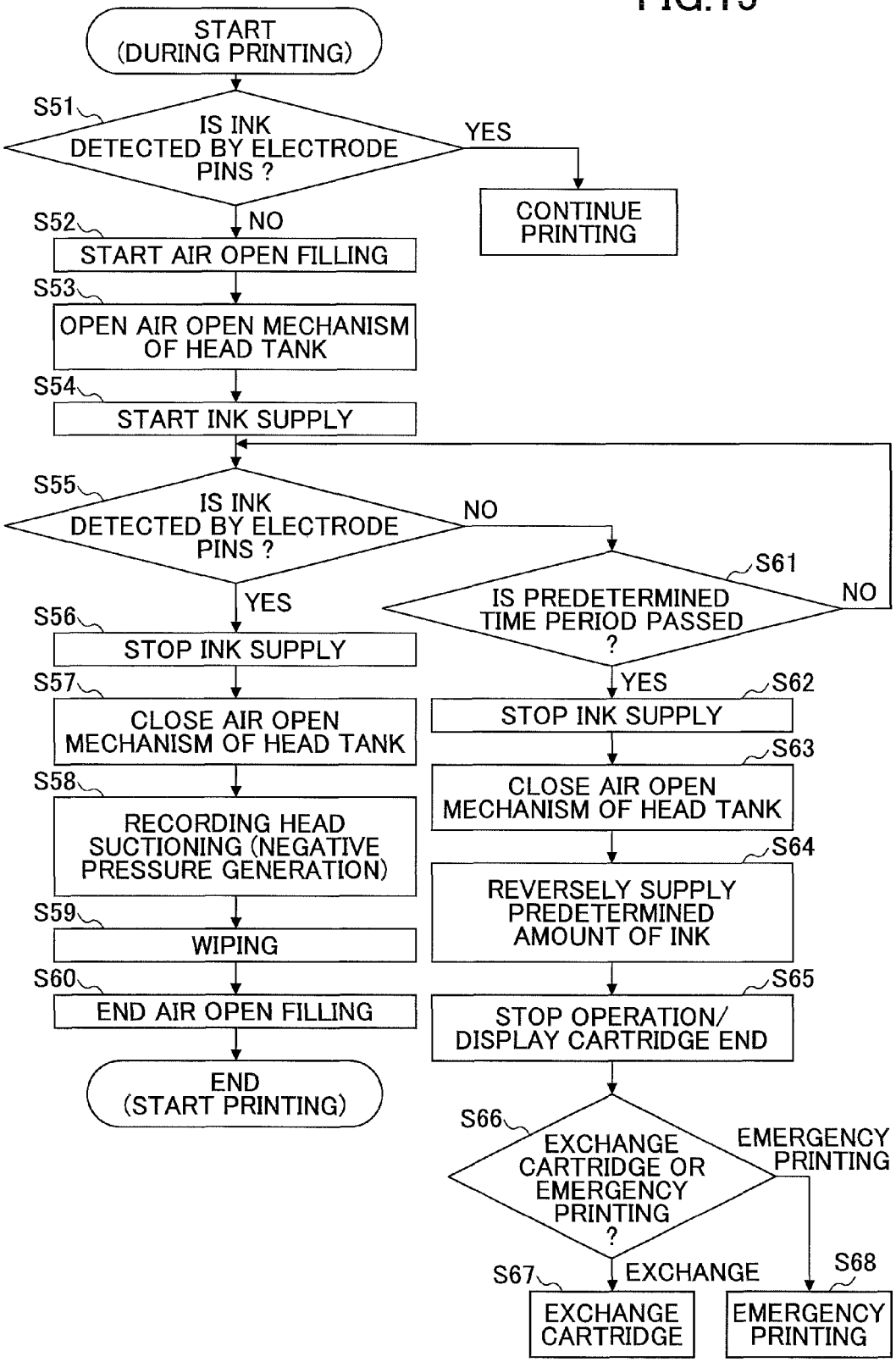
FIG. 15 is a flowchart illustrating the control according to a fourth embodiment of the present invention.

FIG. 15 of this embodiment illustrates an example of the emergency printing where cartridge end is detected while the air is introduced into the head tank 35. In this example, the air amount in the head tank 35 is detected with the electrode pins 208*a* and 208*b*.

Namely, when the height of the liquid surface of ink in the head tank 35 is greater than the heights of the electrode pins 208*a* and 208*b*, a current may flow between the electrode pins 208*a* and 208*b*. Therefore, it may be determined that there is (sufficient) ink in the head tank 35. On the other hand, when the height of the liquid surface of ink in the head tank 35 is less than the height of the electrode pin 208*b* which is less than the height of the electrode pins 208*a*, no current may flow between the electrode pins 208*a* and 208*b*.

Therefore, it may be determined that there is no (insufficient) ink in the head tank 35. When air is introduced into the head tank 35, the height of the liquid surface is lowered. Due to this, when determined that the there is no (insufficient) ink in the head tank 35, the air opening mechanism 207 is opened and ink is supplied until current flows between the electrode pins 208*a* and 208*b* so that air amount in the head tank 35 is reduced. This operation may be herein called a "air open filling". Under this state, however, the cartridge end may occur.

First, as illustrated in FIG. 15, when the printing is started or during the printing, it is determined whether there is (sufficient) ink in the head tank 35 using the electrode pins 208*a* and 208*b* which are provided for detecting the ink amount in the head tank (S51). When determining that there is no (insufficient) ink (i.e, when the air amount is equal to or greater than a predetermined amount), the above "air open filling" operation is started (S52).

In this "air open filling" operation, first, the air opening mechanism 207 of the header tank 35 is opened (S53), and the ink supply of supplying ink from the ink cartridge 10 to the header tank 35 is started (S54). By doing this, extra air may be discharged though the air opening mechanism 207.

In this case, it is determined whether the state where there is (sufficient) ink is detected by using the electrode pins 208*a* and 208*b* within a predetermined time period (S55, S61). When determining that the state where there is (sufficient) ink is detected within the predetermined time period, the ink supply operation is stopped (S56), and the air opening mechanism 207 is closed (S57).

Then, the recording head 34 is capped by the suction cap 82*a* and ink is suctioned (head suction) to generate negative pressure in the head tank 35. The negative pressure may alternatively be generated by reversely driving the fluid supply pump 241 to reversely supply ink. After that, a wiping operation is performed on the recording head 34 (S59), and the "air open filling" operation is terminated (S60), so that the printing may be started.

On the other hand, when determining that the state where there is (sufficient) ink is not detected within the predetermined time period, it is determined that it is in the state of the cartridge end, and the ink supply operation is stopped (S62). Then, after the air opening mechanism 207 is closed (S63), a predetermined amount of ink is (reversely) supplied from the head tank 35 to the ink cartridge 10 to generate negative pressure in the head tank 35 (S64). Then the operation of the apparatus is stopped and an ink end display suggesting the exchange of the cartridge exchange is displayed (S65).

Then, when the user instructs (selects) the exchange of the ink cartridge 10, the cartridge exchange process is performed (S67). On the other hand, when the user instructs (selects) the emergency printing, the emergency printing similar to that described with reference to FIG. 11 is performed (S68).

Figure 16:
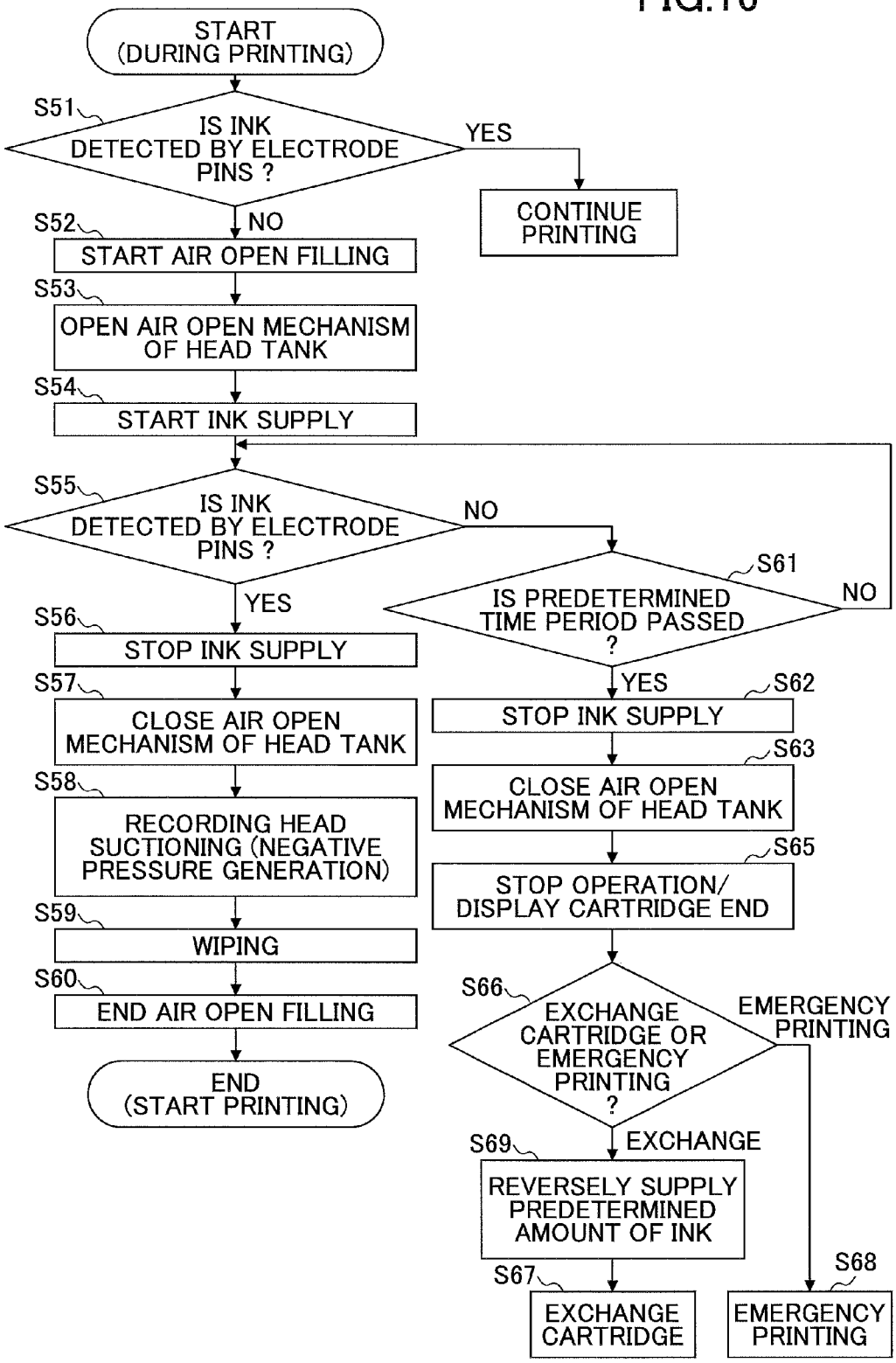
FIG. 16 is a flowchart illustrating the control according to a fifth embodiment of the present invention.

Next, the control according a fifth embodiment of the present invention is described with reference to a flowchart of FIG. 16.

Herein, the relationship of this fifth embodiment to the fourth embodiment corresponds to the relationship of the second embodiment to the first embodiment. Namely the fifth embodiment is similar to the fourth embodiment except that, similar to the second embodiment, the reverse supply of ink from the head tank 35 to the ink cartridge 10 side is not performed before the operation of the apparatus is stopped to exchange the ink cartridge 10. When the ink cartridge is exchanged, the ink is reversely supplied (S69). When the emergency printing is instructed, a similar process as that in second embodiment is performed.

Figure 17:
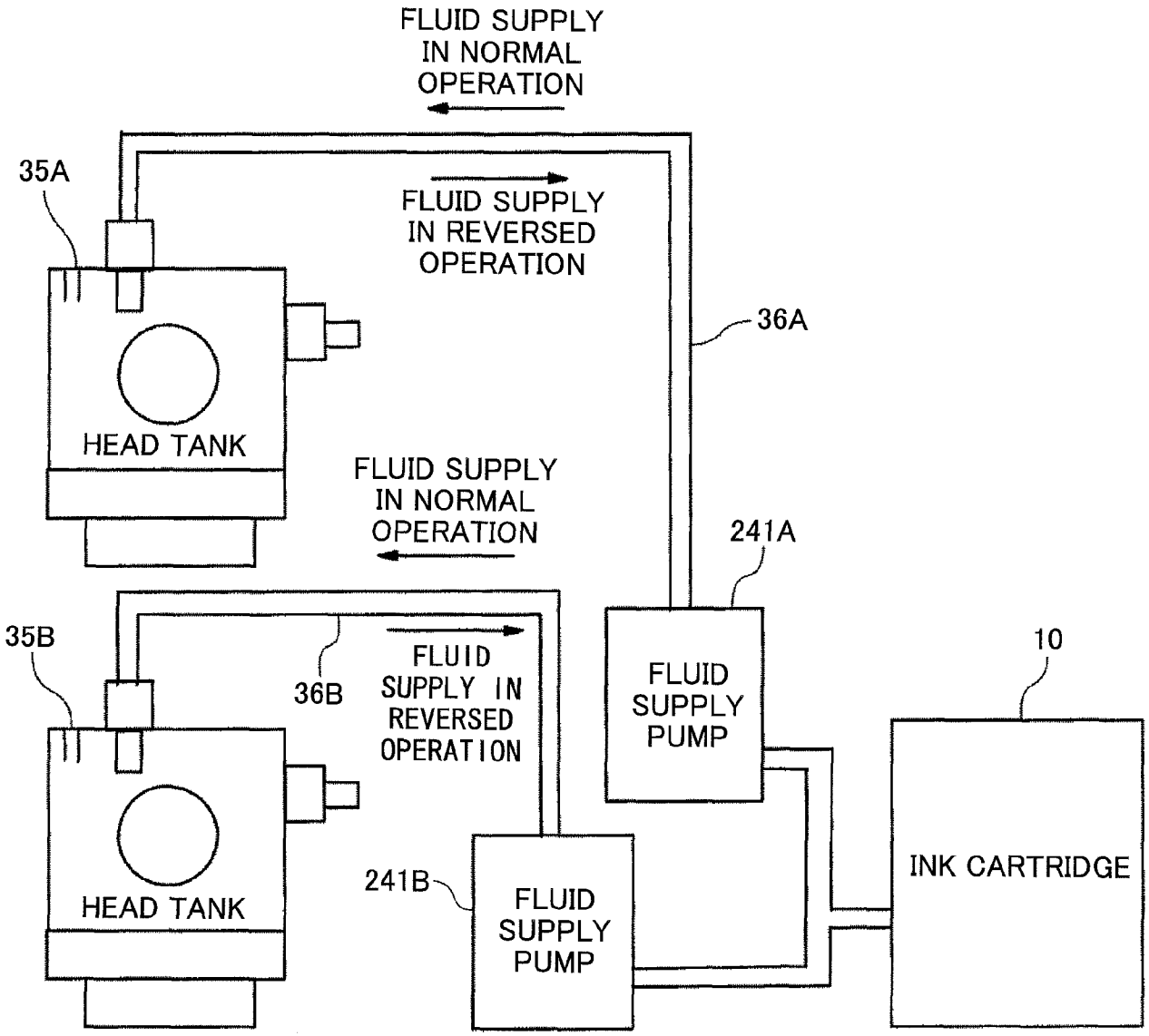
FIG. 17 is a schematic view of an ink supply system according to a sixth embodiment of the present invention.

Next, a sixth embodiment of the present invention is described with reference to FIG. 17. FIG. 17 schematically illustrates an ink supply system of this embodiment.

In this embodiment, as illustrated in FIG. 17, the ink supply system includes two head tanks 35A and 35B connected to the same ink cartridge 10 via respective supply paths. The two supply paths include respective fluid supply pumps 241A and 241B and supply tubes 36A and 36B. Namely, the ink supply system in this embodiment includes more than one head tank for each color ink.

In this embodiment, ink is supplied to the head tanks 35A and 35B using the fluid supply pumps 241A and 241B, respectively, using the two supply paths separated from the single ink cartridge 10. Therefore, the state of the cartridge end of the ink cartridge 10 may be detected during the ink supply operation to either the head tank 35A or the head tank 35B.

Figure 18:
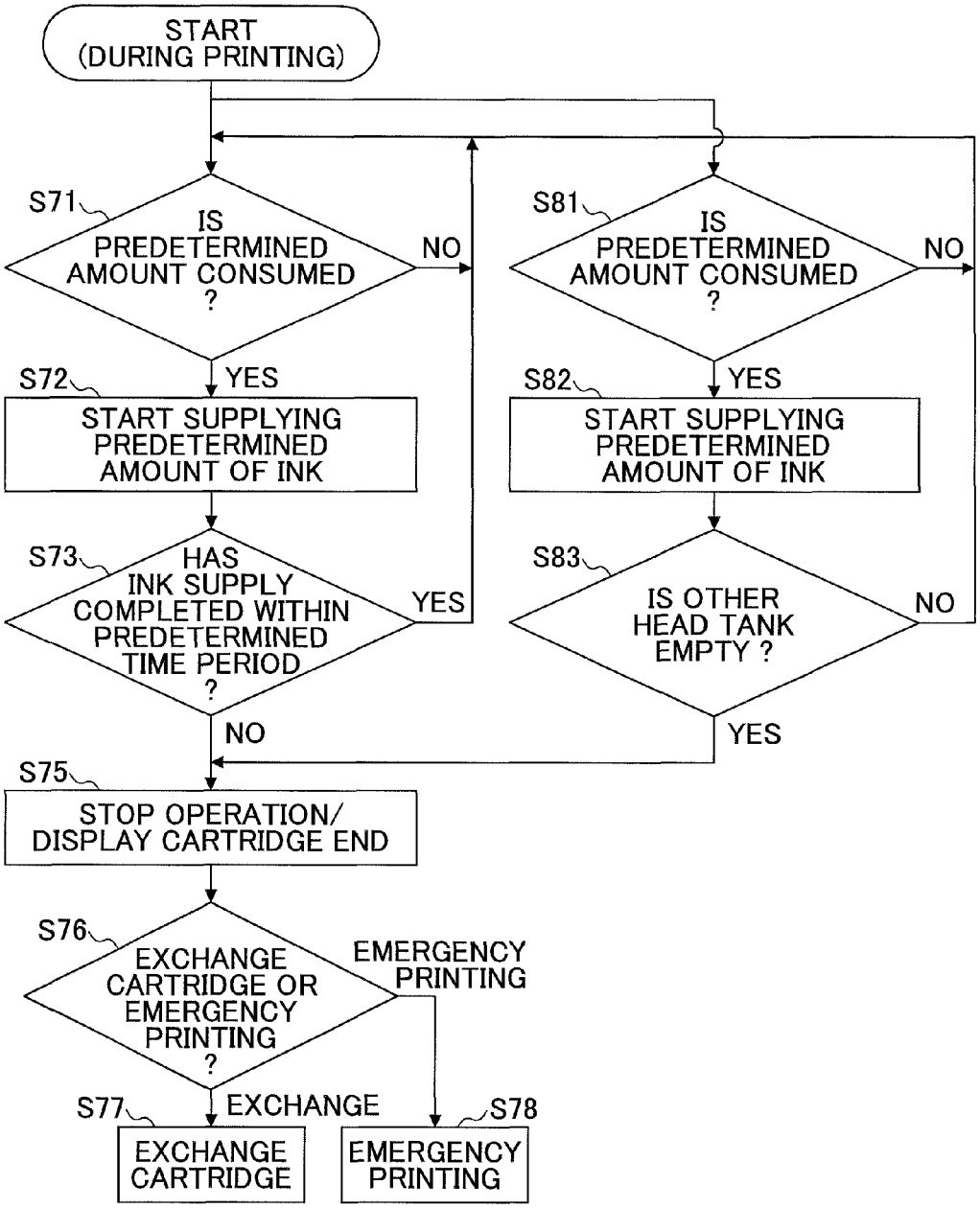
FIG. 18 is a flowchart illustrating the control according to the sixth embodiment of the present invention.

Next, the control according the sixth embodiment of the present invention is described with reference to a flowchart of FIG. 18.

During printing, when it is determined that a predetermined amount of ink is consumed in the head tank 35A (S71), a predetermined amount of ink supply to the head tank 35A is started (S72). Then, it is determined whether the ink supply is completed within a predetermined time period (S73). When determining that the ink supply is not completed within a predetermined time period, the operation of the apparatus is stopped and the ink end display suggesting the exchange of the ink cartridge 10 is displayed (S75). Then, depending on the user's instructions (S76), the exchange of the ink cartridge 10 (S77) or the emergency printing (S78) is performed.

On the other hand, during printing, when it is determined that a predetermined amount of ink is consumed in the head tank 35B (S81), a predetermined amount of ink supply to the head tank 35B is started (S82). Then, it is determined whether the ink amount in the other head tank 35A is zero (not sufficient) (S83).

When determining that the ink amount in the head tank 35A is zero, the process goes to S75, where, as described above, the operation of the apparatus is stopped and the ink end display suggesting the exchange of the ink cartridge 10 is displayed (S75). Otherwise, the process goes to S71.

Namely, the ink consumption count values are separately counted for each of the head tanks 35A and 35B. Further, when the ink consumption count values exceed the threshold values, ink is supplied timely to the corresponding head tanks 35A and 35B.

In this case, when the ink supply is not completed within a predetermined time period, it is determined that the ink cartridge 10 is in the state of the cartridge end. Then, the printing is stopped and the exchange of the ink cartridge 10 is suggested to the user.

Further, in the emergency printing, when the state of the ink cartridge 10 is determined as the cartridge end, the ink amount of one head tank 35 to which ink is being supplied from the ink cartridge 10 may not be sufficient for printing.

In this case, however, the other (another) head tank 35 may be more likely to have sufficient ink for printing. From this point of view, the emergency printing may be performed using only the head tank 35 having sufficient ink, and when it is determined that it is necessary to supply ink to the head tank 35, the printing may be completely stopped.

Figure 19:
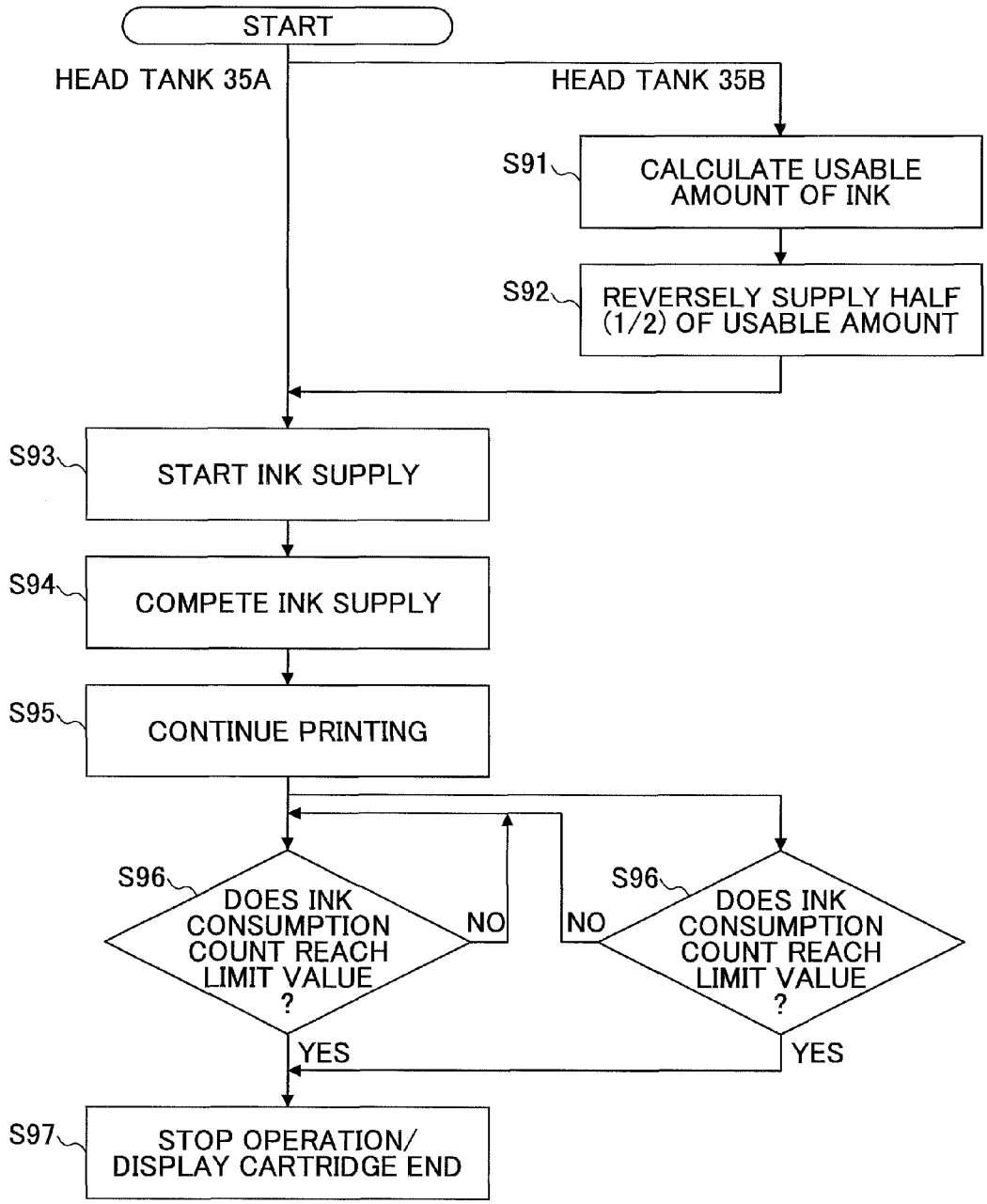
FIG. 19 a flowchart illustrating the control according to a seventh embodiment of the present invention.

Next, the control according a seventh embodiment of the present invention is described with reference to a flowchart of FIG. 19.

In this embodiment, for example, in a case where the state of the ink cartridge 10 is determined as the cartridge end while ink is supplied to a first head tank as described in the sixth embodiment, when the emergency printing is selected, ink is reversely supplied from a second head tank having sufficient ink to the ink cartridge side by reversely driving the fluid supply pump for the second head tank.

Then ink having reversely supplied from the second head tank is supplied from the ink cartridge to the first head tank not having sufficient ink by normally driving the fluid supply pump for the first head tank. By doing this, it may become possible to mutually supply ink between (among) head tanks to make it possible to execute the emergency printing.

To that end, for example, first, an ink usable amount of the head tank other than the head tank which requires ink supply is calculated (S91). Then, a total usable amount of ink in the head tanks corresponding to the color is calculated, and the calculated total usable amount of ink is divided by the number of the total head tanks corresponding to the color (in this example, the number of the total head tanks is "2") to acquire the amount of ink to be reversely supplied to the ink cartridge 10 (S92).

Then, the acquired amount of ink having been reversely supplied to the ink cartridge 10 is supplied to the head tank needing ink to be supplied (S93, S94). In this case, a longer operating time may be set for the ink supply operation so that all mount of ink having been returned to ink cartridge 10 is supplied to the head tank needing ink to be supplied. When all the amount of ink is supplied to the head tank, the ink supply operation is completed.

After that, the emergency printing is continued (S95). Then, the ink consumption amount is counted for each of the head tanks. When determining that any of the ink consumption amounts of the head tanks is equal to a predetermined threshold value (i.e., when determining that ink remaining amount of any one of the head tanks is none (not sufficient)) (S96), the printing is stopped (S97).

The control relevant to the ink supply (normal and reverse supplies) and the various processes such as determination processes and detection processes according to the embodiments of the present invention as described above may be executed by a computer using a program stored in the ROM 502. The program may be downloaded to an image processing apparatus (host 600) and installed in the image forming apparatus.

Further, the above processes may be configured to be executed by a printer driver on the image processing apparatus (host 600) side. Further, by combining an image forming apparatus of the present invention and an image processing apparatus, or by combining an image forming apparatus and an image processing apparatus of the present invention, an image forming system of the present invention may be constituted.

According to an embodiment of the present invention, an image forming apparatus includes a recording head discharging liquid droplets; a head tank including a liquid container containing liquid to be supplied to the recording head and an air opening mechanism opening and closing the liquid container to air; a main tank containing liquid to be supplied to the head tank; a reversible-type fluid supply unit being disposed between the head tank and the main tank and supplying liquid; a pressure detector detecting a pressure in the head tank; a first control unit, when the pressure in the head tank is not restored to a predetermined pressure while liquid is supplied from the main tank to the head tank, determining that the state of the main tank is an empty state, causing the reversible-type fluid supply unit to reversely rotate to reversely supply a predetermined amount of liquid from the head tank to the main tank, and stopping printing; and a second control unit, when the printing is stopped by the first control unit and emergency printing is instructed using liquid remaining in the image forming apparatus, causing the air opening mechanism of the head tank to open, causing the reversible-type fluid supply unit to normally rotate to the supply liquid to the head tank, the liquid having been reversely supplied to the main tank, causing the air opening mechanism to close, and causing the reversible-type fluid supply unit to reversely rotate to reversely supply the liquid from the head tank to the main tank to generate a predetermined negative pressure in the head tank.

According to an embodiment of the present invention, an image forming apparatus includes a recording head discharging liquid droplets; a head tank including a liquid container containing liquid to be supplied to the recording head and an air opening mechanism opening and closing the liquid container to air; a main tank containing liquid to be supplied to the head tank; a reversible-type fluid supply unit being disposed between the head tank and the main tank and supplying liquid; a pressure detector detecting a pressure in the head tank; a first control unit, when the pressure in the head tank is not restored to a predetermined pressure while liquid is supplied from the main tank to the head tank, determining that the state of the main tank is an empty state, causing the reversible-type fluid supply unit to reversely rotate to reversely supply a predetermined amount of liquid from the head tank to the main tank, and stopping printing; and a second control unit, when the printing is stopped by the first control unit and emergency printing is instructed using liquid remaining in the image forming apparatus, causing the reversible-type fluid supply unit to normally rotate to supply the liquid to the head tank, the liquid having been reversely supplied to the main tank, causing the air opening mechanism of the head tank to open, causing the air opening mechanism to close, and causing the reversible-type fluid supply unit to reversely rotate to reversely supply the liquid from the head tank to the main tank to generate a predetermined negative pressure in the head tank.

According to an embodiment of the present invention, an image forming apparatus includes a recording head discharging liquid droplets; a head tank including a liquid container containing liquid to be supplied to the recording head and an air opening mechanism opening and closing the liquid container to air; a main tank containing liquid to be supplied to the head tank; a reversible-type fluid supply unit being disposed between the head tank and the main tank and supplying liquid; a pressure detector detecting a pressure in the head tank; a first control unit, when the pressure in the head tank is not restored to a predetermined pressure while liquid is supplied from the main tank to the head tank, determining that the state of the main tank is an empty state and stopping printing; and a third control unit, when the printing is stopped by the first control unit and exchange of the main tank is instructed, causing the reversible-type fluid supply unit to normally rotate to the supply liquid from the main tank to the head tank, and when the printing is stopped by the first control unit and emergency printing is instructed using liquid remaining in the image forming apparatus, causing the air opening mechanism of the head tank to open, causing the reversible-type fluid supply unit to normally rotate to supply the liquid to the head tank, the liquid having been reversely supplied to the main tank, causing the air opening mechanism to close, and causing the reversible-type fluid supply unit to reversely rotate to reversely supply the liquid from the head tank to the main tank to generate a predetermined negative pressure in the head tank.

According to an embodiment of the present invention, an image forming apparatus may further include a control unit, when the negative pressure in the head tank is increased in the emergency printing and it becomes necessary to supply liquid from the main tank, causing the air opening mechanism of the head tank to open, causing the reversible-type fluid supply unit to normally rotate to the supply liquid to the head tank, the liquid having been reversely supplied to the main tank, causing the air opening mechanism to close, and causing the reversible-type fluid supply unit to reversely rotate to reversely supply the liquid from the head tank to the main tank to generate a predetermined negative pressure in the head tank.

According to embodiments of the present invention, an image forming apparatus includes a first control unit, when the pressure in the head tank is not restored to a predetermined pressure while liquid is supplied from the main tank to the head tank, to determine that the state of the main tank is an empty state, causing the reversible-type fluid supply unit to reversely rotate to reversely supply a predetermined amount of liquid from the head tank to the main tank, and stop printing; and a second control unit, when the printing is stopped by the first control unit and emergency printing is instructed using liquid remaining in the image forming apparatus, either causing the air opening mechanism of the head tank to open and then cause the reversible-type fluid supply unit to normally rotate to supply the liquid to the head tank, the liquid having been reversely supplied to the main tank, or cause the reversible-type fluid supply unit to normally rotate to supply the liquid to the head tank, the liquid having been reversely supplied to the main tank and then causing the air opening mechanism of the head tank to open, and then causing the air opening mechanism to close and causing the reversible-type fluid supply unit to reversely rotate to reversely supply the liquid from the head tank to the main tank to generate a predetermined negative pressure in the head tank. By having this configuration, it may become possible to reduce ink to be wastefully consumed in the printing operation using the liquid (ink) remaining in the head tank.

Further, according to an embodiment of the present invention, an image forming apparatus includes a first control unit, when the pressure in the head tank is not restored to a predetermined pressure while liquid is supplied from the main tank to the head tank, determining that the state of the main tank is an empty state and stopping printing; and a third control unit, when the printing is stopped by the first control unit and exchange of the main tank is instructed, causing the reversible-type fluid supply unit to normally rotate to supply the liquid from the main tank to the head tank, and when the printing is stopped by the first control unit and emergency printing is instructed using liquid remaining in the image forming apparatus, causing the air opening mechanism of the head tank to open, causing the reversible-type fluid supply unit to normally rotate to supply the liquid to the head tank, the liquid having been reversely supplied to the main tank, causing the air opening mechanism to close, and causing the reversible-type fluid supply unit to reversely rotate to reversely supply the liquid from the head tank to the main tank to generate a predetermined negative pressure in the head tank. By having this configuration, it may become possible to reduce ink to be wastefully consumed in the printing operation using the liquid (ink) remaining in the head tank.

Although the invention has been described with respect to specific embodiments for a complete and clear disclosure, the appended claims are not to be thus limited but are to be construed as embodying all modifications and alternative constructions that may occur to one skilled in the art that fairly fall within the basic teachings herein set forth.

What is claimed is:

1. An image forming apparatus comprising:

a recording head configured to discharge liquid droplets;

a head tank including a liquid container configured to contain liquid to be supplied to the recording head and an air opening mechanism configured to open and close the liquid container to air;

a main tank configured to contain liquid to be supplied to the head tank;

a reversible-type fluid supply unit disposed between the head tank and the main tank and configured to supply liquid;

a pressure detector configured to detect a pressure in the head tank;

a first control unit configured to, when the pressure in the head tank is not restored to a predetermined pressure while liquid is supplied from the main tank to the head tank, determine that the state of the main tank is an empty state, cause the reversible-type fluid supply unit to reversely rotate to reversely supply a predetermined amount of liquid from the head tank to the main tank, and stop printing; and a second control unit configured to, when the printing is stopped by the first control unit and emergency printing is instructed using liquid remaining in the image forming apparatus, cause the air opening mechanism of the head tank to open, cause the reversible-type fluid supply unit to normally rotate to the supply liquid to the head tank, the liquid having been reversely supplied to the main tank, cause the air opening mechanism to close, and cause the reversible-type fluid supply unit to reversely rotate to reversely supply the liquid from the head tank to the main tank to generate a predetermined negative pressure in the head tank.

2. The image forming apparatus according to claim 1, further comprising:

a control unit configured to, when the negative pressure in the head tank is increased in the emergency printing and it becomes necessary to supply liquid from the main tank, cause the air opening mechanism of the head tank to open, cause the reversible-type fluid supply unit to normally rotate to the supply liquid to the head tank, the liquid having been reversely supplied to the main tank, cause the air opening mechanism to close, and cause the reversible-type fluid supply unit to reversely rotate to reversely supply the liquid from the head tank to the main tank to generate a predetermined negative pressure in the head tank.

3. An image forming apparatus comprising:

a recording head configured to discharge liquid droplets;

a head tank including a liquid container configured to contain liquid to be supplied to the recording head and an air opening mechanism configured to open and close the liquid container to air;

a main tank configured to contain liquid to be supplied to the head tank;

a reversible-type fluid supply unit disposed between the head tank and the main tank and configured to supply liquid;

a pressure detector configured to detect a pressure in the head tank;

a first control unit configured to, when the pressure in the head tank is not restored to a predetermined pressure while liquid is supplied from the main tank to the head tank, determine that the state of the main tank is an empty state, cause the reversible-type fluid supply unit to reversely rotate to reversely supply a predetermined amount of liquid from the head tank to the main tank, and stop printing; and a second control unit configured to, when the printing is stopped by the first control unit and emergency printing is instructed using liquid remaining in the image forming apparatus, cause the reversible-type fluid supply unit to normally rotate to the supply liquid to the head tank, the liquid having been reversely supplied to the main tank, cause the air opening mechanism of the head tank to open, cause the air opening mechanism to close, and cause the reversible-type fluid supply unit to reversely rotate to reversely supply the liquid from the head tank to the main tank to generate a predetermined negative pressure in the head tank.

4. The image forming apparatus according to claim 3, further comprising:

a control unit configured to, when the negative pressure in the head tank is increased in the emergency printing and it becomes necessary to supply liquid from the main tank, cause the air opening mechanism of the head tank to open, cause the reversible-type fluid supply unit to normally rotate to the supply liquid to the head tank, the liquid having been reversely supplied to the main tank, cause the air opening mechanism to close, and cause the reversible-type fluid supply unit to reversely rotate to reversely supply the liquid from the head tank to the main tank to generate a predetermined negative pressure in the head tank.

5. An image forming apparatus comprising:

a recording head configured to discharge liquid droplets;

a head tank including a liquid container configured to contain liquid to be supplied to the recording head and an air opening mechanism configured to open and close the liquid container to air;

a main tank configured to contain liquid to be supplied to the head tank;

a reversible-type fluid supply unit disposed between the head tank and the main tank and configured to supply liquid;

a pressure detector configured to detect a pressure in the head tank;

a first control unit configured to, when the pressure in the head tank is not restored to a predetermined pressure while liquid is supplied from the main tank to the head tank, determine that the state of the main tank is an empty state and stop printing; and a third control unit configured to, when the printing is stopped by the first control unit and exchange of the main tank is instructed, cause the reversible-type fluid supply unit to normally rotate to the supply liquid from the main tank to the head tank, and when the printing is stopped by the first control unit and emergency printing is instructed using liquid remaining in the image forming apparatus, cause the air opening mechanism of the head tank to open, cause the reversible-type fluid supply unit to normally rotate to the supply liquid to the head tank, the liquid having been reversely supplied to the main tank, cause the air opening mechanism to close, and cause the reversible-type fluid supply unit to reversely rotate to reversely supply the liquid from the head tank to the main tank to generate a predetermined negative pressure in the head tank.

6. The image forming apparatus according to claim 5, further comprising:

a control unit configured to, when the negative pressure in the head tank is increased in the emergency printing and it becomes necessary to supply liquid from the main tank, cause the air opening mechanism of the head tank to open, cause the reversible-type fluid supply unit to normally rotate to the supply liquid to the head tank, the liquid having been reversely supplied to the main tank, cause the air opening mechanism to close, and cause the reversible-type fluid supply unit to reversely rotate to reversely supply the liquid from the head tank to the main tank to generate a predetermined negative pressure in the head tank.

* * * * *